US006921989B2

(12) United States Patent
Baranowski et al.

(10) Patent No.: US 6,921,989 B2
(45) Date of Patent: Jul. 26, 2005

(54) ELECTRICAL SWITCHGEAR WITH SYNCHRONOUS CONTROL SYSTEM AND ACTUATOR

(75) Inventors: John Francis Baranowski, Franklin, WI (US); Debra Jennifer Jochum, Oak Creek, WI (US); Charles John Knotek, Racine, WI (US); Aleksander Mankowski, Long Grove, IL (US); Michael Peter Dunk, Caledonia, WI (US)

(73) Assignee: McGraw-Edison Company, Houston, TX (US)

( * ) Notice: Subject to any disclaimer, the term of this patent is extended or adjusted under 35 U.S.C. 154(b) by 17 days.

(21) Appl. No.: 10/301,678

(22) Filed: Nov. 22, 2002

(65) Prior Publication Data

US 2003/0071522 A1 Apr. 17, 2003

Related U.S. Application Data

(60) Division of application No. 09/343,094, filed as application No. PCT/US96/07114 on May 15, 1996, now Pat. No. 6,538,347, which is a continuation-in-part of application No. 08/440,783, filed on May 15, 1995, now abandoned.

(51) Int. Cl.[7] ..... H01H 3/00

(52) U.S. Cl. ..... 307/139; 307/125; 200/144 R; 218/154

(58) Field of Search ..... 218/154; 200/144 R; 307/125, 139

(56) References Cited

U.S. PATENT DOCUMENTS

| | | | | | |
|---|---|---|---|---|---|
| 3,594,614 | A | * | 7/1971 | Halbeck et al. | 361/142 |
| 3,641,359 | A | * | 2/1972 | McCarty | 307/136 |
| 4,479,040 | A | * | 10/1984 | Denley et al. | 200/77 |
| 4,686,337 | A | * | 8/1987 | Crookston et al. | 218/84 |
| 5,436,414 | A | * | 7/1995 | Hodkin et al. | 200/17 R |
| 5,486,662 | A | * | 1/1996 | Takiishi | 200/50.27 |
| 5,627,738 | A | * | 5/1997 | Lubomirsky et al. | 363/49 |

* cited by examiner

*Primary Examiner*—Robert L. DeBeradinis
(74) *Attorney, Agent, or Firm*—Fish & Richardson P.C.

(57) ABSTRACT

A closed loop feedback system controls electrical switchgear that moves at least one contact relative to another contact to switch power on and off in an AC electrical circuit. The control system includes a position feedback device that is operatively coupled to at least one of the two contacts to produce contact position information. A processor receives and analyzes the contact position information to control contact motion to provide AC waveform synchronized switching. The electrical switchgear may be a capacitor switch that includes a bi-stable over-toggle latching device. The latching device maintains the contacts in one of an open stable position in which electrical current does not flow through the contacts or a closed stable position in which electrical current flows through the contacts.

31 Claims, 26 Drawing Sheets

1340
| 1200 Capacitor Switch ON: | Reference Phase | Leading Phase | Lagging Phase |
|---|---|---|---|
| 1315 Toggle Switch | POS 1 | POS 1 | POS 3 |
| 1320 Toggle Switch | POS 3 | POS 1 | POS 3 |
FIG. 13D
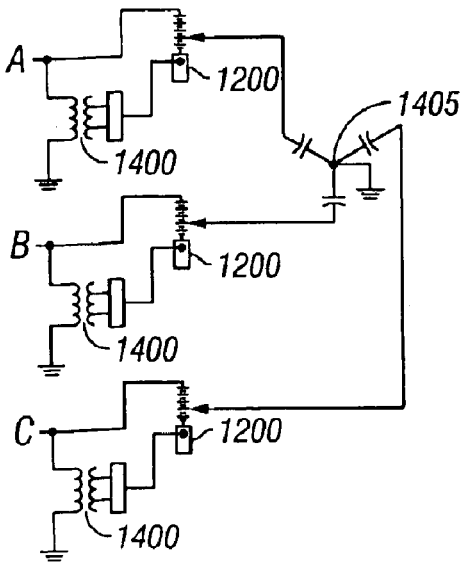
FIG. 14A
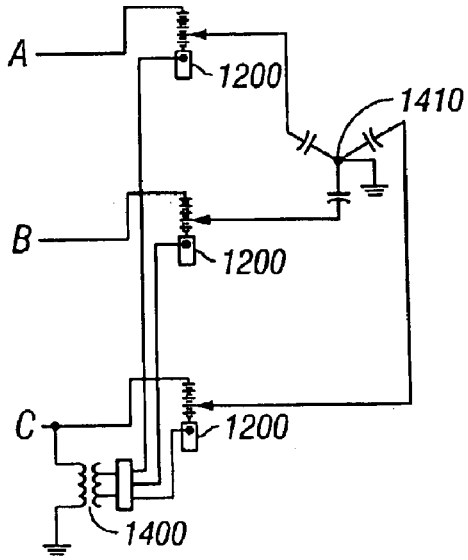
FIG. 14B

ELECTRICAL SWITCHGEAR WITH SYNCHRONOUS CONTROL SYSTEM AND ACTUATOR

CROSS REFERENCE TO RELATED APPLICATION

This present application is a divisional application of U.S. application Ser. No. 09/343,094, filed Jun. 30, 1999 now U.S. Pat. No. 6,538,347; which is related to U.S. Pat. No. 6,291,911, issued Sep. 18, 2001; which is related to U.S. Pat. No. 6,331,687; issued Dec. 18, 2001; which claims priority from International Application No. PCT/US96/07114, filed on May 15, 1996; which is a continuation-in-part of U.S. application Ser. No. 08/440,783, filed on May 15, 1995, now abandoned. All of these applications and/or patents are herein incorporated by reference.

FIELD OF THE INVENTION

The invention relates to controlling electrical switchgear. More particularly, the invention relates to continuously and automatically optimizing switchgear performance.

BACKGROUND

In a power distribution system, switchgear are typically employed to protect the system against abnormal conditions, such as power line fault conditions or irregular loading conditions. There are different types of switchgear for different applications. A fault interrupter is one type of switchgear. Fault interrupters are employed to automatically open a power line upon the detection of a fault condition.

Reclosers are another type of switchgear. In response to a fault condition, a recloser, unlike a fault interrupter, rapidly trips open and then recloses the power line a number of times in accordance with a set of time-current curves. Then, after a predetermined number of trip/reclose operations, the recloser will "lock-out" the power line if the fault condition has not been cleared.

A breaker is a third type of switchgear. Breakers are similar to reclosers. However, they are generally capable of performing only a single open-close-open sequence, and the currents at which they interrupt current flow are significantly higher than those of reclosers.

A capacitor switch is a fourth type of switchgear. Capacitor switches are used for energizing and de-energizing capacitor banks. Capacitor banks are used for regulating the line current feeding a large load (e.g., an industrial load) when the load causes the line current to lag behind the line voltage. Upon activation, a capacitor bank pushes the line current back into phase with the line voltage, thereby boosting the power factor (i.e., the amount of power being delivered to the load). Capacitor switches generally perform one open operation or one close operation at a time.

As switchgear contacts come into proximity with one another (i.e., during a closing operation) or when the contacts first separate (i.e., during an opening operation), some amount of arcing occurs between the contacts. Arcing can cause an excessive amount of heat to build up on the surface of the contacts, which can cause the contacts to wear-out at an excessively fast rate. Arcing can also strain or damage system components such as power transformers. Therefore, arcing is highly undesirable.

In general, all switchgear, irrespective of type, attempt to minimize arcing. Some switchgear designs attempt to accomplish this by driving the switchgear contacts apart (i.e., during an opening operation) or together (i.e., during a closing operation) as fast as possible. The theory behind this approach is that if the amount of time the contacts spend in close proximity to one another is minimized, arcing is also minimized. In practice, this strategy is flawed, particularly during closing operations, because the contacts tend to bounce when they come into physical contact with each other, with the amount of bounce increasing as the relative velocity of the contacts increases. Contact bounce, in turn, leads to the generation of undesirable transient voltage and current events.

A more effective method for minimizing arcing and minimizing the generation of transients is to synchronize the initiation of the switchgear operation so that the actual closing or opening of the contacts occurs when the AC voltage or current across the contacts is at zero volts or zero amperes, respectively. For example, in FIG. 1, it is preferable that a closing of the contacts occurs when the AC voltage waveform 100 passes through a zero-voltage crossover point, such as point A. Generally, for true synchronous operations, it is preferable to close at a voltage zero across the switchgear contacts and to open at a current zero to minimize arc time. Normal arc interruptions occur at a current zero. For a capacitor switch application, the capacitor load current leads the voltage by 90 electrical degrees. Therefore, the current waveform does not need to be monitored and it can be assumed that at a voltage zero the current is at a peak and at a current zero the voltage is at a peak. For true synchronous operations for other applications, both the voltage waveform and current waveform need to be monitored to achieve the proper synchronous timings.

Present switchgear designs that employ a synchronizing method generally do so by predefining a fixed amount of time $t_1$, where $t_1$, is equal to a presumed AC voltage waveform period T less an amount of time $t_2$ corresponding to an approximate amount of time required to complete the switchgear operation. This is referred to as fixed time synchronization. For example, in FIG. 1, if the AC voltage waveform is operating at 60 Hz, the period T of the AC waveform 100 is 16.66 msec. If the predefined time $t_2$ is 11.66 msecs, then $t_1$, is 5 msecs. Accordingly, if a switchgear employing this method receives a command to initiate a close operation, the switchgear will detect a next zero-voltage crossover point, such as crossover point B in FIG. 1, then wait $t_1$, msecs, which corresponds with point C in FIG. 1, to initiate the switching operation. Likewise, if an open command is received, the switchgear will detect a next zero current crossover point and determine an appropriate opening point that is somewhat similar to the timing sequence described above for the closing operation. The opening point is determined such that a contact opening gap sufficient to interrupt the flow of current and withstand the power system recovery voltage to prevent reignitions or restrikes is established at the next zero current crossover. From here on, the discussion will focus on synchronized voltage switching. However, it will be understood by one skilled in the art that switching could also be synchronized with the current waveform on opening.

Unfortunately, the fixed time synchronization method does not always produce accurate results. First, the AC voltage waveform 100 rarely propagates at exactly 60 Hz. In fact, it generally fluctuates slightly above and below 60 Hz. Accordingly, the period T of the AC voltage waveform 100 will fluctuate. Therefore, initiating a switching operation at point C does not always guarantee a synchronized opening or closing operation (i.e., an operation that is synchronized with a zero-voltage crossover point). Second, conditions such as ambient temperature can affect the dynamic friction of the mechanism and change the actual amount of time that it takes for the contacts to complete the switching operation. Therefore, the amount of time represented by $t_2$ may fluctuate with temperature. Thus, once again, initiating the switching operation at point C is not likely to consistently result in a synchronized opening or closing operation. Third, over the life of the switchgear, the distance the contacts must travel during a switching operation generally increases. This is due to ordinary contact wear and wear from the components of the mechanism. As the contact travel distance increases, it becomes less likely that initiating the switching operation at point C as a function $t_1$, $t_2$ and T will result in a synchronized switching operation. Therefore, present switchgear designs that employ the fixed time synchronization method must be manually recalibrated frequently to maintain their precise synchronous timing.

In the particular case of a capacitor switch, minimizing arcing and minimizing the generation of transients is especially important. That is because even small inaccuracies in synchronizing a switching operation with a zero-voltage crossover point on the AC voltage waveform can result in arcing and/or transients that involve thousands of amperes and volts. Therefore, an enormous demand exists for a switchgear design, particularly a capacitor switch design, that provides automatic compensation for more accurate, point-on-wave switching operation control, to better assure zero-voltage switching operations to minimize transient effects.

SUMMARY

A system employing the present invention provides precise, point-on-wave switching performance by employing a closed-loop feedback, microprocessor-based motion control design. By employing a closed-loop feedback, microprocessor-based design, the system can monitor and optimize switchgear contact motion (i.e., position and velocity) during a switching operation, thereby assuring a more accurate switching operation. Moreover, the closed-loop feedback design intrinsically self-compensates for the effects of factors such as ambient temperature, AC waveform fluctuations, and changes in the physical condition of the switchgear. In addition, the system can optimize various motion control parameters both during and subsequent to a switching operation, to better assure that present and future operations are more accurately synchronized with the AC voltage or current waveform of the AC electrical circuit.

The system promises to minimize arcing and transients during switching operations, and to provide accurate, consistent point-on-wave switching. The system may continuously monitor and optimize, in real-time, the moving components of the system, based on present switching operation performance, to assure more consistent and accurate, point-on-wave switching.

The system also may periodically optimize the moving components based on past switching operation performance, to assure more accurate, point-on-wave switching operations.

In accordance with one general aspect of the invention, a closed-loop feedback control system for electrical switchgear that moves one contact relative to another contact to switch power on and off in the AC electrical circuit includes a position sensor and a processor. The position sensor is operatively coupled to at least one of the two contacts to produce contact position information. The processor, in turn, is configured to receive and analyze the contact position information to control contact motion to provide AC waveform synchronized switching.

Embodiments may include one or more of the following features.

The processor may control a single AC phase of the AC electrical circuit. Likewise, the AC electrical circuit may include a poly-phase circuit and the processor may control each phase of the AC electrical circuit. The AC electrical circuit may include a power line.

The processor may control contact motion based on a comparison between the contact position information and a target contact position. The target contact position may be based on prior contact position information.

The processor may use the contact position information to determine erosion in electrical switchgear components or residual contact life.

The closed loop feedback control system may include a hermetically-sealed bottle that houses the switchgear contacts. The processor may use the contact position information to detect fractures or leaks in the bottle.

The feedback system may be part of a capacitor switch. The capacitor switch may include a latching device that maintains the contacts in one of an open stable position in which electrical current does not flow through the contacts or a closed stable position in which electrical current flows through the contacts.

The capacitor switch may include a mechanical trip mechanism that allows an operator of the capacitor switch to manually open switch contacts. The mechanical trip mechanism, when activated by the operator, may open switch contacts at least as fast as the closed loop feedback control system.

The mechanical trip mechanism may include a trip lever, a handle, a compression spring, a trip plunger, a spring plate, and a trip finger. The handle, when pulled by the operator, may rotate the trip lever. The trip plunger may couple the trip lever to the compression spring such that rotation of the trip lever pushes the trip plunger in a direction that compresses the compression spring. The spring plate may couple the compression spring to the movable contact. The trip finger may rotate away from the compression spring when contacted by the trip plunger to release the spring plate and move the movable contact away from the other contact.

The mechanical trip mechanism may also include a return spring that, after operator activation, may automatically reset the mechanical trip mechanism independently from closed loop feedback control system operations. The mechanical trip mechanism may be reset by the operator after operator-activation. Furthermore, the contacts may remain open until the closed loop feedback control system moves the contacts closed.

In accordance with yet another general aspect of the invention, a latching device used in an electrical switchgear includes a shaft operable to move along a shaft axis, a piston operable to move along a piston axis, a biasing device, and a linkage. The shaft is coupled to a contact of the switchgear and operable to move along the shaft axis between a first stable position in which an electrical path including the contact is closed and a second stable position in which an electrical path including the contact is open. The biasing device is coupled to the piston to exert a biasing force on the piston along the piston axis and the piston, in turn, is coupled to the shaft through the linkage. The linkage is configured such that the biasing force on the piston is transferred to the shaft to bias the shaft to one of the stable positions.

Embodiments may include one or more of the following features.

The shaft may be operable to move along the shaft axis between the first stable position, the second stable position, and a third stable position in which an electrical path including the contact is open. Furthermore, the piston axis may be perpendicular to the shaft axis.

The latching device may further include a biasing adjustment that adjusts the biasing force of the biasing device. Likewise, the latching device may include a biasing retainer that fixes the biasing force of the biasing device.

The latching device may include a second piston operable to move along a second piston axis, a second biasing device, and a second linkage. The second biasing device is coupled to the second piston to exert a second biasing force on the second piston along the second piston axis and, in turn, the second piston is coupled to the shaft through the second linkage. The second linkage is configured such that the second biasing force is transferred to the shaft to bias the shaft to one of the stable positions. The shaft may be operable to move along the shaft axis between the first stable position, the second stable position, and a third stable position in which an electrical path including the contact is open.

The biasing device may include a spring. Furthermore, the shaft may be insulated from the contact.

The first stable position may be constrained such that the biasing force is maximally coupled to the contact through the shaft. The constraint may ensure that the electrical path is closed in the first stable position. The constraint may account for contact erosion. Likewise, the second stable position may be constrained such that the biasing force is maximally coupled to the shaft along the shaft axis. The piston may be operable to move a distance that ensures that the electrical path is closed in the first stable position and that the electrical path is open in the second stable position.

The latching device may further include a shock absorbing system that includes at least one shock absorbing piston operable to move along a shock absorbing axis and at least one shock absorbing biasing device. The shock absorbing piston couples to the shaft and the shock absorbing biasing device is coupled to the shock absorbing piston to exert a shock absorbing biasing force on the shock absorbing piston along the shock absorbing axis. The shock absorbing piston is configured such that the shock absorbing biasing force dampens contact bounce at at least one stable position. The shock absorbing axis may be parallel to the shaft axis. Furthermore, the shock absorbing biasing force may prevent contact bounce at at least one stable position.

The shaft may be coupled to multiple contacts of the switchgear. Each contact may correspond to a phase of polyphase AC power.

Other features and advantages will be apparent from the following description, including the drawings, and from the claims.

DESCRIPTION OF THE DRAWINGS

FIGS. 13A–13D illustrate application settings for the synchronous closing capacitor switch.

FIGS. 14A and 14B illustrate application of the synchronous closing capacitor switch of FIGS. 12 and 13A–C in a three-phase distribution system.

DETAILED DESCRIPTION

Figure 2:
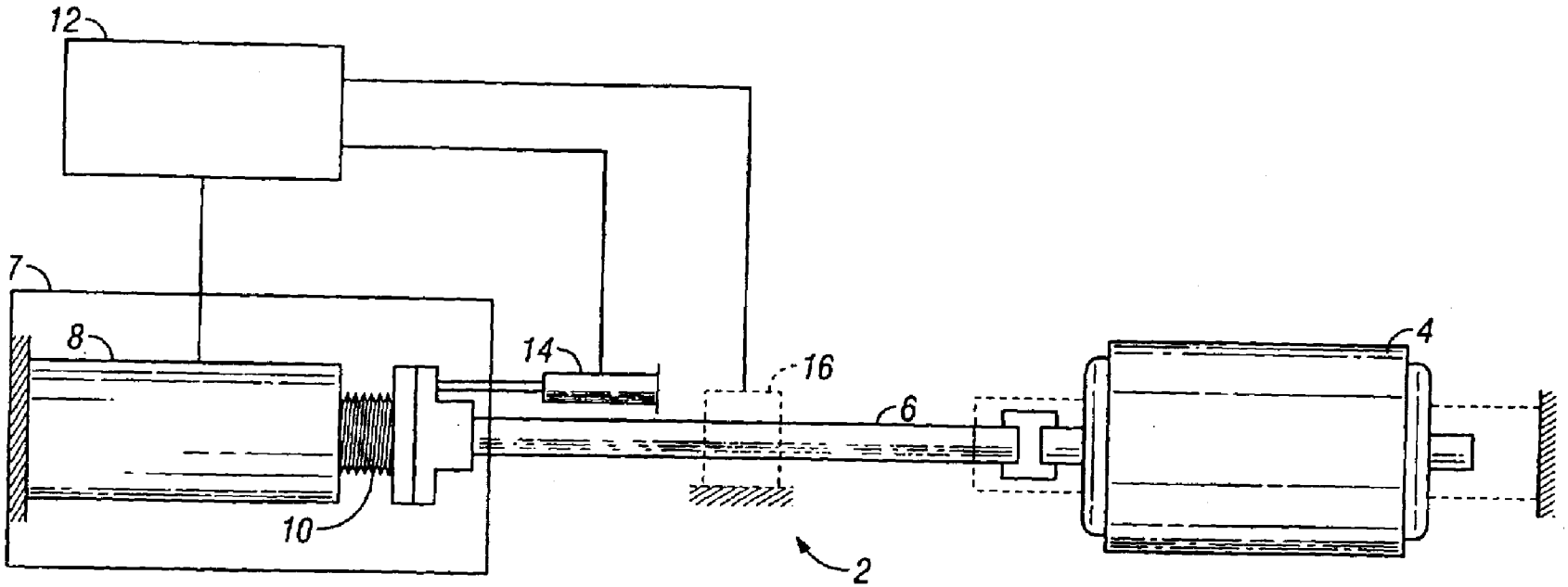
FIG. 2 is a diagram illustrating components of a capacitor switch.
Figure 3:
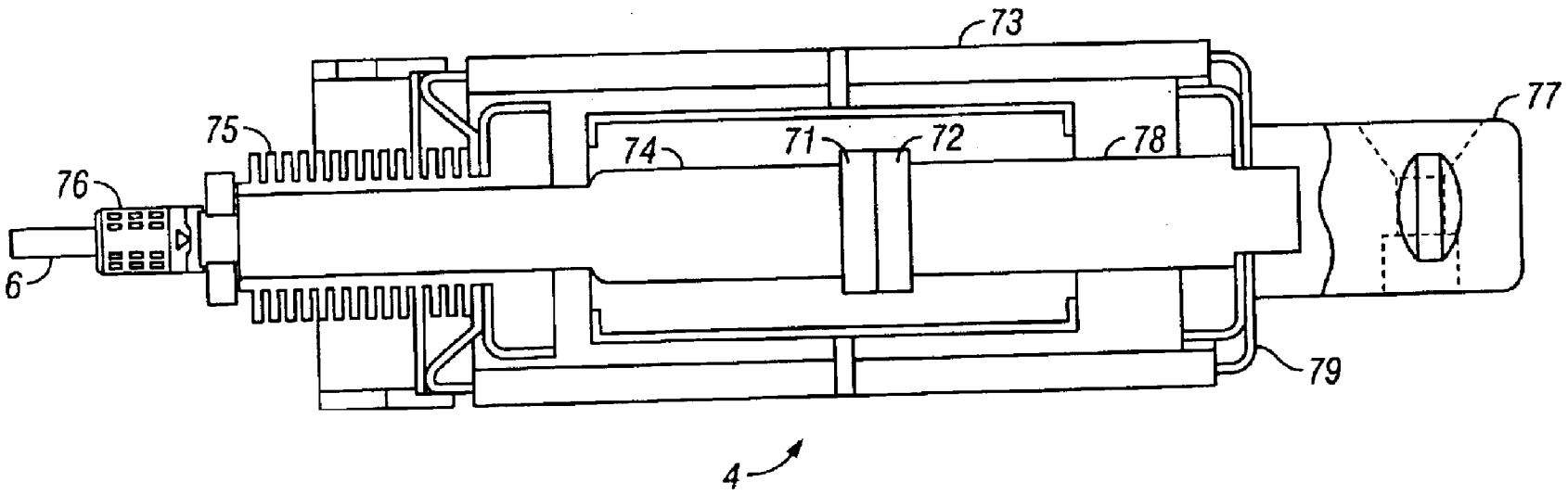
FIG. 3 is a cross-sectional view of a current interrupter.
Figure 4:
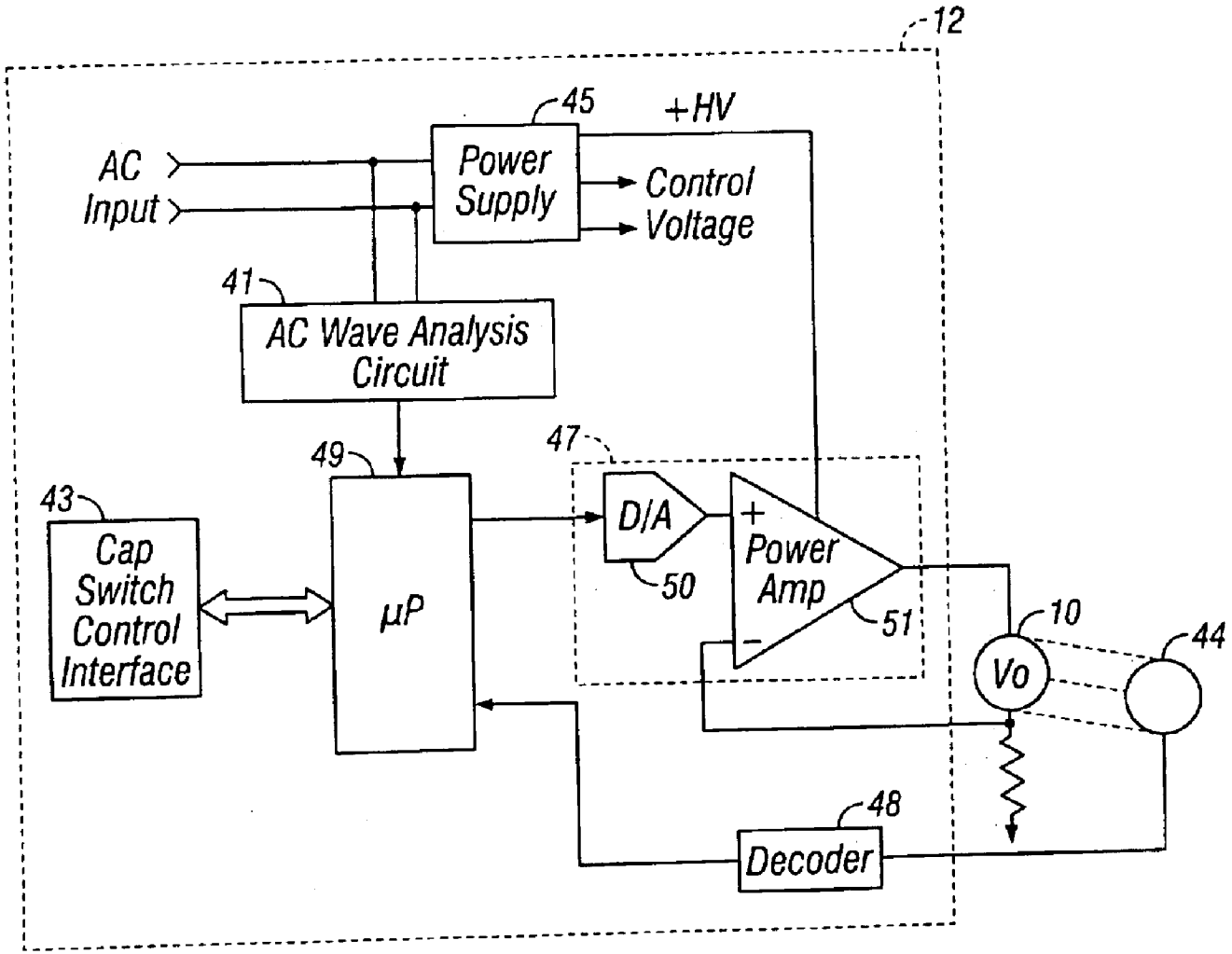
FIG. 4 is a schematic of a motion control circuit.

Referring to FIGS. 2–4, a synchronously-closing capacitor switch 2 employs a microprocessor based control system with closed-loop position-feedback monitoring to provide higher switching reliability and stability. Components of the capacitor switch 2 include a voice coil actuator 8, a coil winding 10, a latching device 16, an operating rod 6, a current interrupter 4, a motion control circuit 12 and a position feedback device 14. Other fast actuators that could be used instead of the voice coil actuator include linear motors and hydraulic mechanisms. The control system also is applicable to other types of switchgear.

In general, the capacitor switch illustrated in FIG. 2 operates as follows. A voice coil mechanism 7, which is a direct drive, limited motion device, essentially contains two components: a stationary part that includes a gapped magnetic field (voice coil actuator 8) and a movable part (the voice coil winding 10). The voice coil mechanism 7 operates in response to current flowing in the voice coil winding 10. This current reacts with the steady-state magnetic field in the gap of the magnetic structure of voice coil actuator 8 to exert a force on the voice coil winding 10. The force exerted on the winding is transferred to the operating rod 6, which is attached to the winding. The resulting force on the operating rod 6 is proportional to the current flowing through the voice coil winding 10 and causes the operating rod 6 to move along its axis to develop the force associated with an opening operation or a closing operation. The rod moves, either backward or forward, depending upon the direction of the current flow through the coil winding 10. The movement of the operating rod 6, in turn, causes a pair of switchgear contacts 71, 72, located in the current interrupter 4 as illustrated in FIG. 3, to either come together or to pull apart, depending upon whether the switching operation is an opening operation or a closing operation.

The switchgear contacts 71, 72 are essentially contained inside current interrupter 4. As shown, switchgear contact 71 is connected to the conductor rod 74 that goes through the bellows 75 and attaches to the siding current interchange 76 that in turn is coupled to the operating rod 6. Accordingly, the flexible bellows 75 allows the contact 71 to move axially as a function of the movement of the operating rod 6 and is referred to as the movable contact. In contrast, switchgear contact 72 is stationary and is called the fixed contact. Contact 72 is connected to the conductor rod 78 that goes through the end cap 79 and attaches to the source side terminal 77. When the contacts 71, 72 come together during a closing operation, an AC circuit is made through the current interrupter's contacts from the fixed contact or source side terminal 77 to the movable contact or the load side terminal that makes contact with the sliding current interchange 76 and allows the current to flow through the contacts 71, 72 of the closed switch. The contacts 71, 72 separate during an opening operation to open the AC circuit and stop current flow.

FIG. 3 shows current interrupter 4 in cross section. Current interrupter 4 includes a vacuum bottle containing the switchgear contacts 71, 72. The vacuum bottle provides a housing and an evacuated environment for the switchgear contacts 71, 72. The vacuum bottle is usually constructed from an elongated, generally tubular, evacuated, ceramic casing 73, preferably formed from alumina. Instead of the vacuum module, an interrupter containing a dielectric medium, such as SF6, oil or air, may also be employed.

Current flow through coil winding 10 is controlled by the motion control circuit 12. The motion control circuit 12 is connected to the position feedback device 14. The position feedback device 14 provides the motion control circuit 12 with real-time contact position feedback information during each switching operation. The motion control circuit 12 can determine real-time contact velocity information from the contact position information. The motion control circuit 12 uses the real-time position and velocity information to achieve synchronized switching operations in accordance with a closed-loop feedback strategy, as will be described in greater detail below.

The motion control circuit 12 is also coupled to a latching device 16. When instructed by the motion control circuit 12, the latching device 16 holds the operating rod 6 in its current position. The latching device 16 may be a canted spring, a ball plunger, a magnetic-type latch, a bi-stable spring, a spring over-toggle or another equivalent latch. The latching device 16 must, however, provide enough contact pressure to minimize switchgear contact resistance and to hold the contacts together during rated, momentary currents. Though the energized voice coil actuator could act as its own latch, this generally is undesirable for economic reasons.

The motion control circuit 12 is illustrated in greater detail in FIG. 4. As shown, the motion control circuit 12 includes an AC waveform analysis circuit 41, a capacitor switch control interface 43, a position sensor and encoder 44, a power supply 45, a pulse width modulation unit (PWM) 47, a decoder 48 and a microprocessor 49. This design incorporates a single, small microprocessor per single-phase device to handle the supervisory control functions and the closed loop motion control. However, a single, more powerful microprocessor could be used to handle all these functions for each phase of a poly-phase application. The following discussion focuses on a single microprocessor per device to simplify the description.

The power supply 45 provides a number of controlled voltage levels for the motion control circuit 12. First, it supplies a voltage level HV that powers the amplifier in the PWM unit 47. The amplifier in the PWM unit 47, in turn, powers the voice coil winding 10 via a MOSFET bridge (not shown in FIG. 4) that drives the mechanism's movement. The power supply 45 also provides a number of control voltages, such as a 15 VDC and a 5 VDC for the low power electronic devices.

The AC voltage waveform analysis circuit 41 provides timing information that relates to the zero-voltage crossover points of the AC voltage waveform. The circuit 41 derives this information from the incoming AC voltage input to the power supply 45. The AC voltage waveform analysis circuit 41 generates a pulse coincident to the occurrence of each zero-voltage crossover point. Each pulse is transmitted to the microprocessor 49, and is used by the switching operation control procedure described below to generate different interrupt signals. The interrupt signals, which also are discussed in greater detail below, are crucial for ensuring synchronized switching operations. The AC voltage waveform analysis circuit 41 may include a waveform analyzer, a phase-locked loop, and a zero-voltage detection circuit.

The switching operation execute command signals that instruct the capacitor switch to open or close are typically generated by a capacitor bank control system (not shown), but also may be generated manually. The switching operation execute commands are fed to the microprocessor 49 on optically isolated input lines, through the industry standard capacitor switch control interface 43. The capacitor switch control interface 43 is generally a five pin connector which provides the open command signal on a first pin, the close command signal on a second pin, a ground on a third pin, and a two-line 120 volt AC power input on fourth and fifth pins.

The PWM unit 47 is located between the microprocessor 49 and the voice coil winding 10. During a switching operation, the PWM unit 47 continuously receives digital current control signals from the microprocessor 49. In response, the PWM unit 47 generates a current that flows through the voice coil winding 10. This current reacts with the magnetic field present in the gap of the magnetic structure of the voice coil actuator 8 to, in turn, generate a force on the voice coil winding 10. In this manner, the microprocessor 49 controls the relative position and velocity of the switchgear contact 71 during each switching operation. The PWM unit 47 may include a digital-to-analog converter 50 and a bi-polar power amplifier 51.

The microprocessor 49 is central to the motion control circuit 12. In particular, the microprocessor 49 uses the information that it receives from the capacitor switch control interface 43, the AC voltage waveform analysis circuit 41, and the position feedback device 14 to execute a switching operation control procedure. The switching operation control procedure is used by the microprocessor 49 to optimize switching operation performance by ensuring AC voltage waveform synchronization.

To close the motion control feedback loop, switchgear contact position information must be fed back to the microprocessor in the motion control circuit 12. This is the function of the position feedback device 14. The position feedback device 14 includes a sensor, an encoder 44 and a decoder 48. The encoder 44 is an optical quadrature encoder. The encoder also could be implemented using any number of linear devices, such as, for example, a linear potentiometer, a LVDT, or a linear tachometer.

The position feedback device 14 performs two primary functions. First, the position feedback device 14 continuously samples the position of the movable contact 71 during a switching operation. The position information is then encoded by the encoder 44, which feeds the information to decoder 48. Decoder 48 then digitizes the position data and forwards it to the microprocessor 49. For example, the decoder 48 may provide the data once every 250 μsecs. The microprocessor 49 and, more specifically, the switching operation control procedure executed by the microprocessor 49 then use the information to continuously optimize the position and velocity of the switchgear contact 71 during a switching operation.

Second, the position feedback device 14 provides the switching operation control procedure with information relating to the total distance traveled by the movable contact 71 during the previous switching operation. This information is used by the switching operation control procedure to establish an initial contact position at the beginning of each switching operation.

The switching operation control procedure executed by the microprocessor 49 performs the essential operations necessary to provide AC voltage waveform synchronized switching, also referred to as point-on-wave switching. The switching operation control procedure is implemented in software. The software may be stored in a memory resident on the microprocessor 49, or in a separate memory device.

In general, the switching operation control procedure ensures AC voltage waveform synchronized switching by (1) establishing an optimal switching operation initiation time, based on data received from the AC voltage waveform analysis circuit 41, following the receipt of the switching operation execute command; (2) monitoring the capacitor switch control interface 43 for a switching operation execute command (i.e., an open or close command); (3) establishing an initial contact position; (4) initiating the switching operation at the optimal switching operation initiation time; and (5) driving the contact 71 from the initial contact position to an ending contact position in accordance with a pre-programmed motion profile. These functions will now be described in greater detail.

Figure 1:
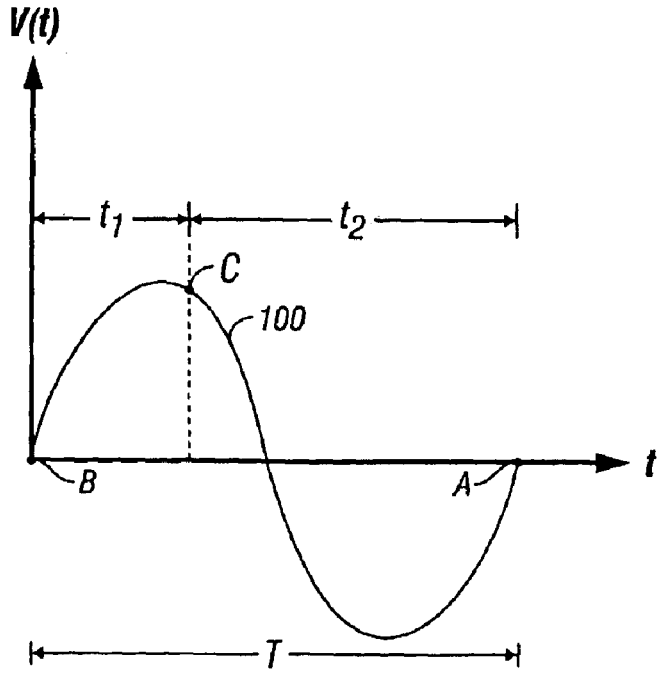
FIG. 1 is a graph illustrating an AC voltage or current waveform.

First, the switching operation control procedure determines when the switching operation is to be initiated, following a switching operation execute command, to achieve AC voltage waveform synchronized switching. To accomplish this, the switching operation control procedure relies on zero-voltage crossover timing information that takes the form of a sequence of timing pulses, with each timing pulse corresponding to the occurrence of a zero-voltage crossover point (e.g., point B in FIG. 1). As stated above, the pulses are generated by the AC voltage waveform analysis circuit 41.

More specifically, the switching operation control procedure uses the timing pulses to generate at least two different types of interrupt signals. The first type is a zero-voltage crossover interrupt signal $V_{INT}$, which is generated each time the microprocessor 49 receives a timing pulse from the AC voltage waveform analysis circuit 41. Hence, a $V_{INT}$ interrupt signal is simultaneously generated each time the AC waveform passes through a zero-voltage crossover point. Accordingly, if the AC voltage waveform is oscillating at exactly 60 cycles/second, there are 120 zero crossings in a second (2 zero crossings/cycle*60 cycles/second) and a $V_{INT}$ interrupt signal is generated every 8.33 msecs.

The second type of interrupt signal generated by the switching operation control procedure is the time interval $T_{INT}$ interrupt signal. In one implementation, 32 $T_{INT}$ signals, corresponding to 32 time intervals of equal length, are generated during each half-cycle of the AC voltage waveform. By counting each $T_{INT}$ interrupt signal generated since the last $V_{INT}$ interrupt signal, the switching operation control procedure is able to determine exactly where it is along the AC voltage waveform. Moreover, if the switching operation control procedure is able to determine how many $T_{INT}$ interrupt signals have been generated since the last $V_{INT}$ interrupt signal (i.e., since the last zero-voltage crossover point), the switching operation control procedure is able to determine how many additional $T_{INT}$ interrupt signals are to be generated before the next $V_{INT}$ interrupt signal (i.e., before the next zero-voltage crossover point).

In one implementation, the switching operation control procedure determines the optimal switching operation initiation time as a function of the number of $T_{INT}$ intervals required to complete the switching operation, which in turn, is determined based on the distance that the movable contact 71 will travel and the velocity at which the movable contact 71 will travel during the switching operation. The velocity of the movable contact 71 throughout the switching operation is defined by a desired motion profile.

Figure 7:
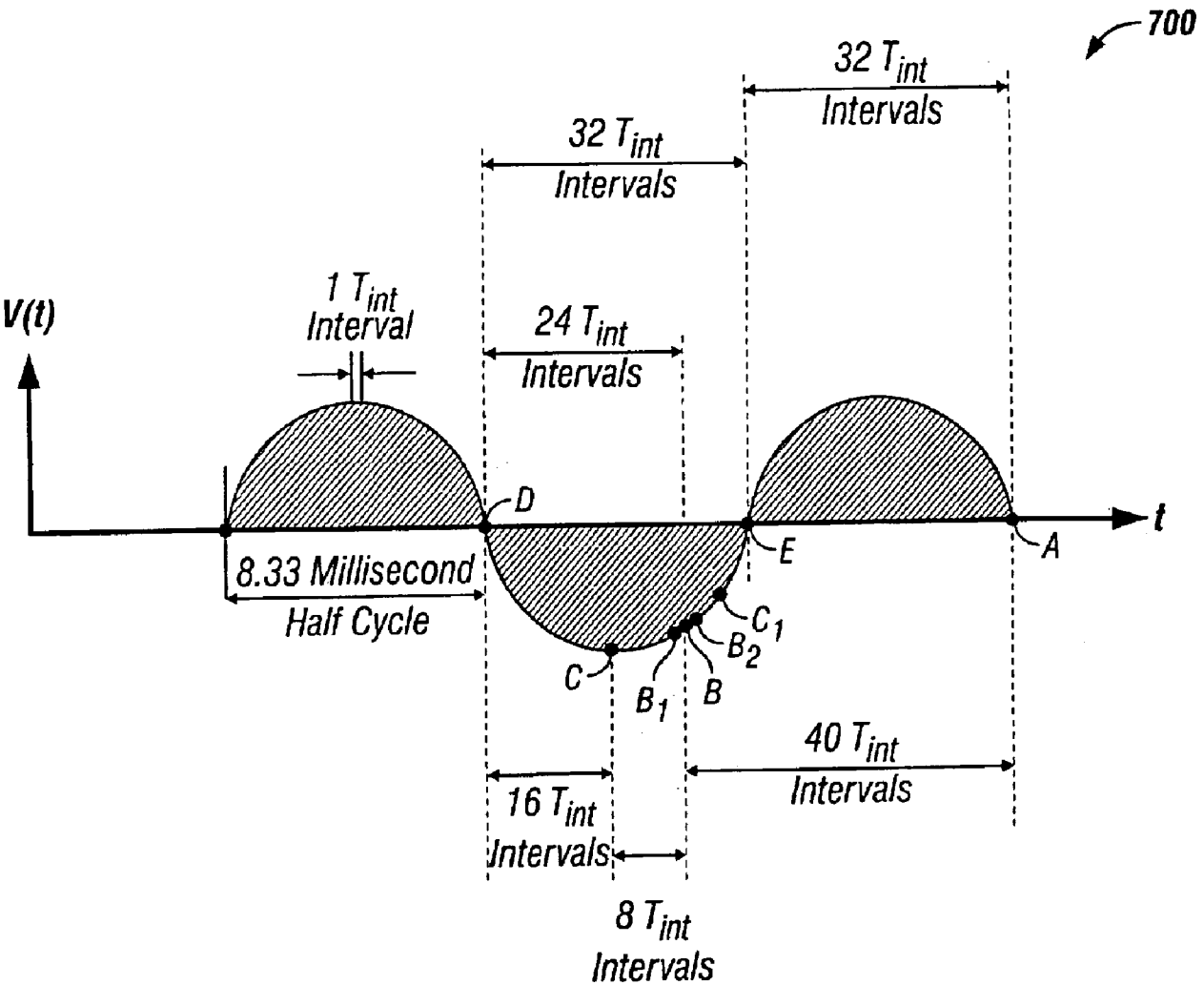
FIG. 7 is a graph illustrating an AC voltage waveform.

FIG. 7 shows an exemplary AC voltage waveform 700, with each half-cycle of the AC voltage waveform 700 divided into 32 equally spaced $T_{INT}$ intervals. If, for example, 40 $T_{INT}$ intervals are required to complete the switching operation, the switching operation control procedure must initiate the switching operation no later than point B along the AC voltage waveform 700 to achieve AC voltage waveform synchronized switching at point A. As shown, 24 $T_{INT}$ intervals separate point D and point B, and 40 $T_{INT}$ intervals separate point B and point A. Accordingly, if the switching operation control procedure receives a switching operation execute command at point C, 16 $T_{INT}$ intervals separate point D and point C, the switching operation control procedure must wait until it receives exactly 8 additional $T_{INT}$ interrupt signals before initiating the switching operation at point B.

To ensure optimal switching performance on a continuing basis, the switching operation control procedure must adjust for any change in the amount of time (i.e., for any change in the number of $T_{INT}$ intervals) required to complete a switching operation. In the previous example, it was stipulated that 40 $T_{INT}$ intervals were required to complete the switching operation. Over the life of the capacitor switch, the number of $T_{INT}$ intervals required to complete an AC voltage waveform synchronized switching operation is not likely to change, or, at least, is not likely to change significantly. However, the system tracks the performance of each switching operation and, in doing so, determines if and when the switching operations become asynchronous. If, for example, the switching operations are consistently overshooting the intended zero-voltage crossover point, the switching operation control procedure can adjust to begin initiating the switching operations earlier than before by an appropriate number of $T_{INT}$ intervals (e.g., at point $B_1$ in FIG. 7 rather than point B). Similarly, if the switching operations are consistently undershooting the intended zero-voltage crossover point, the switching operation control procedure can adjust itself so that it begins initiating switching operation later than before by an appropriate number of $T_{INT}$ intervals (e.g., at point $B_2$ in FIG. 7 rather than point B).

If, in the example illustrated in FIG. 7, the switching operation control procedure receives a switching operation execute command at point $C_1$ rather than at point C, the switching operation control procedure knows that there is an insufficient period of time to achieve AC voltage synchronized switching at point A. Accordingly, the switching operation control procedure continues to track the $T_{INT}$ interrupt signals and initiates the switching operation 24 $T_{INT}$ interrupt signals after receiving the next $V_{INT}$ interrupt signal (i.e., the $V_{INT}$ interrupt signal associated with the next zero-voltage crossover point, which corresponds to point E in FIG. 7), to thereby achieve AC voltage waveform synchronized switching at the zero-voltage crossover point following point A (not shown in FIG. 7).

At the onset of each switching operation, the switching operation control procedure establishes an initial contact position. As explained above, the initial contact position represents the distance that the movable contact 71 is expected to travel during the present switching operation. In one implementation, the switching operation control procedure establishes this initial contact position as the actual distance traveled by the movable contact 71 during the previous switching operation. As noted above, the switching operation control procedure obtains the actual distance traveled by the movable contact 71 from the position feedback device 14.

As also noted above, the distance which the movable contact 71 must travel to complete a switching operation may gradually increase over the life of the capacitor switch, due to contact wear, mechanism wear, and seasonal changes due to temperature effects. However, it will be understood that from one switching operation to the next, any increase is expected to be small. Therefore, by setting the initial contact position equal to the distance traveled by the movable contact 71 during the previous switching operation, the switching operation control procedure accounts for incremental changes that occur over the life of the capacitor switch, which in turn, allows the switching operation control procedure to continuously optimize the performance of each switching operation.

For example, if the movable contact 71 traveled a total distance of 100 units during the previous switching operation, the switching operation control procedure, at the onset of the present switching operation, sets the initial contact position to 100 units. As will be explained in greater detail below, the switching operation control procedure actually treats the initial contact position as a position error, which must be reduced to zero precisely at the intended zero-voltage crossover point.

Once a switching operation has been initiated, the switching operation control procedure continuously regulates the amount of current flowing into the voice coil winding 10. This, in turn, controls the amount of force driving the movable contact 71 from its initial position to its ending position.

Figure 6:
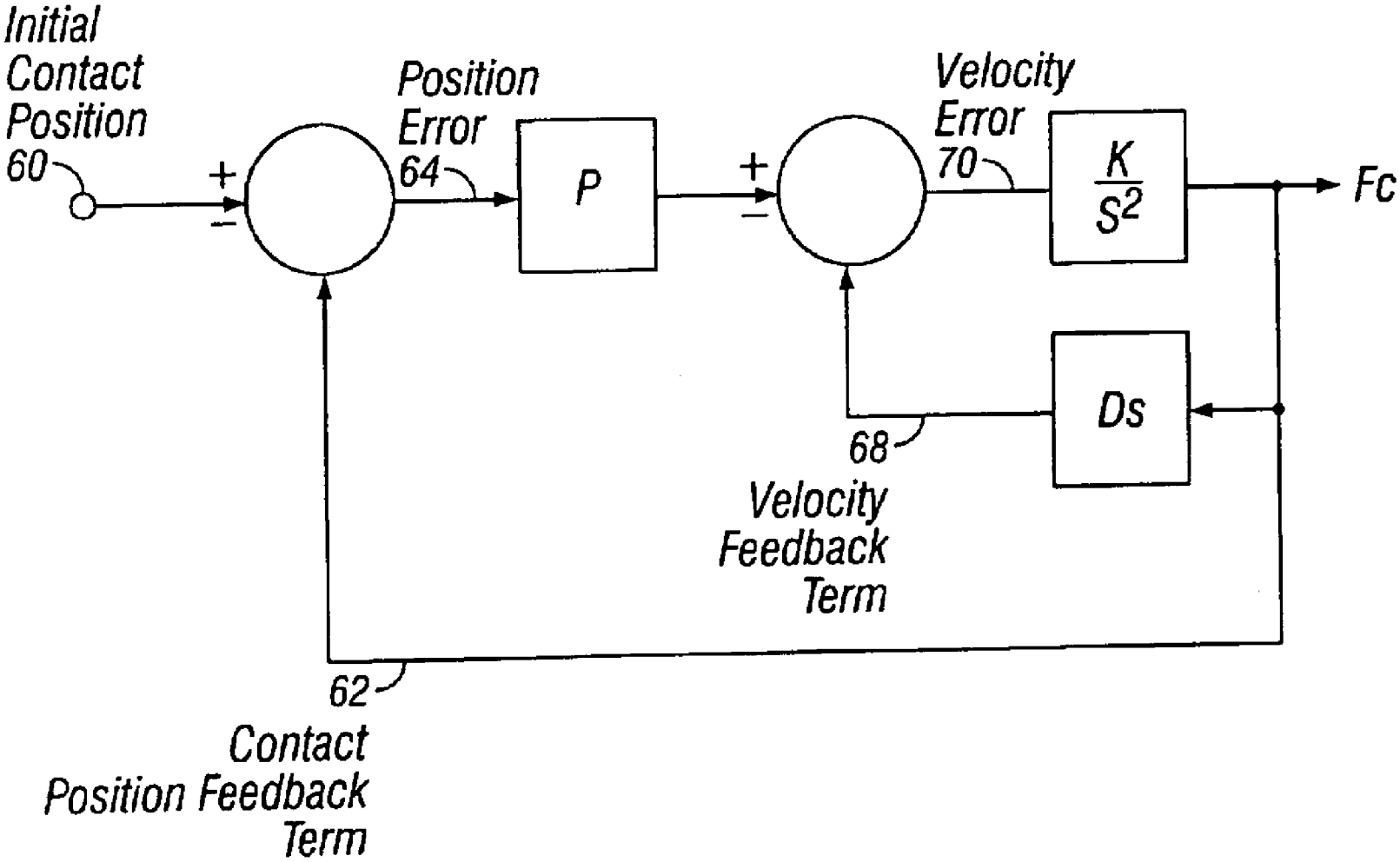

In one implementation, the switching operation control procedure regulates the current by executing the closed-loop, position feedback process shown in FIG. 6. This process uses the value 60 associated with the initial contact position. As stated above, the initial contact position represents the distance which the movable contact 71 is expected to travel during the present switching operation, and it equals the actual distance traveled by the movable contact 71 during the previous switching operation. During the present switching operation, the value associated with the initial contact position 60 is continuously compared in real-time with the contact position feedback term 62, which is fed back into the switching operation control procedure by the position feedback device 14. This comparison produces a position error 64. The position error 64 represents the distance that the movable contact 71 still must travel to complete the switching operation. Accordingly, the switching operation control procedure attempts to drive the position error 64 to zero precisely at the intended zero-voltage crossover point. The position error 64 is then multiplied by a scaling constant P, which is then compared with the velocity feedback term 68. The switching operation control procedure derives the velocity feedback term 68 from the contact position feedback term 62. The second comparison results in a velocity error 70. The velocity error 70 is then used by the switching operation control procedure to control the amount of current to the voice coil winding 10 to follow the desired motion profile. The transfer function associated with the process depicted in FIG. 6 is as follows:

$$\frac{C(s)}{R(s)} = \frac{(KP^2)}{s^2 + KDs + KP^2}. \tag{1}$$

Figure 8A:
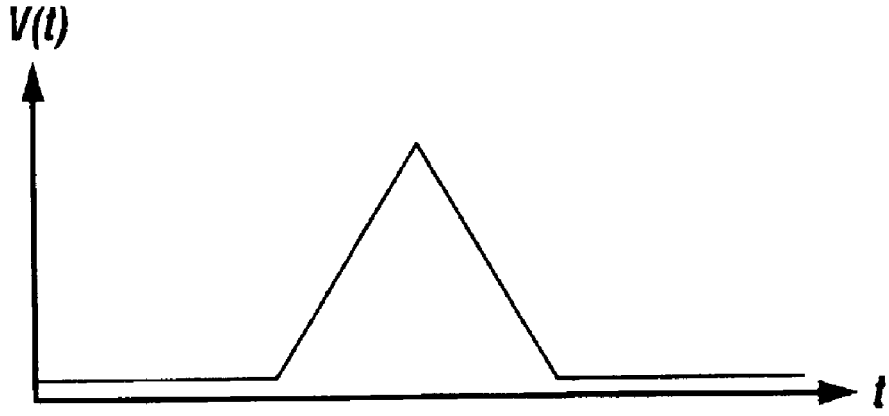
FIGS. 8A–8C illustrate exemplary motion profiles.

FIG. 8A depicts an exemplary motion profile. As stated above, a motion profile defines the velocities at which the movable contact 71 should be traveling over the duration of a switching operation to achieve AC voltage waveform synchronized switching. The motion profile is, in turn, defined by the process transfer function, for example, the process transfer function of equation (1). By adjusting the transfer function values P and/or D in equation (1), the exemplary motion profiles illustrated in FIGS. 8B and 8C may be achieved, instead of the motion profile illustrated in FIG. 8A.

By accomplishing each of the above-identified functions, the switching operation control procedure is able to optimize switching performance in a number of ways. First, the switching operation control procedure inherently optimizes switching operation performance by virtue of the position feedback process itself. That is because position and velocity information are fed back to the switching operation control procedure in real-time (e.g., every 250 $\mu$secs) during the switching operation. The switching operation control procedure then uses the information to continuously correct (i.e., increase or decrease) the amount of current controlling the force applied to the movable contact 71, thereby ensuring AC voltage waveform synchronized switching.

Second, if there is excessive position error (e.g., the movable contact 71 is not accelerating rapidly enough to achieve the motion profile by a significant amount), the switching operation control procedure is capable of adjusting certain transfer function parameters during the switching operation to preserve AC voltage waveform synchronized switching. For example, if the position error signal is excessively large, the switching operation control procedure can adjust the value of D appropriately. If, however, the velocity error is excessively large, the switching operation control procedure can adjust the value of P.

Third, in addition to adjusting the transfer function parameters in real-time, the switching operation control procedure is capable of storing performance data from a previous switching operation (e.g., position and velocity values) and then comparing the prior performance data to corresponding points along the desired motion profile. The difference between the stored values and the motion profile values can then be used to determine whether it is necessary to further adjust the transfer function parameters, that is, the values of P and D, or the ratio of P to D, to assure AC voltage waveform synchronized switching for subsequent switching operations.

Figure 9:
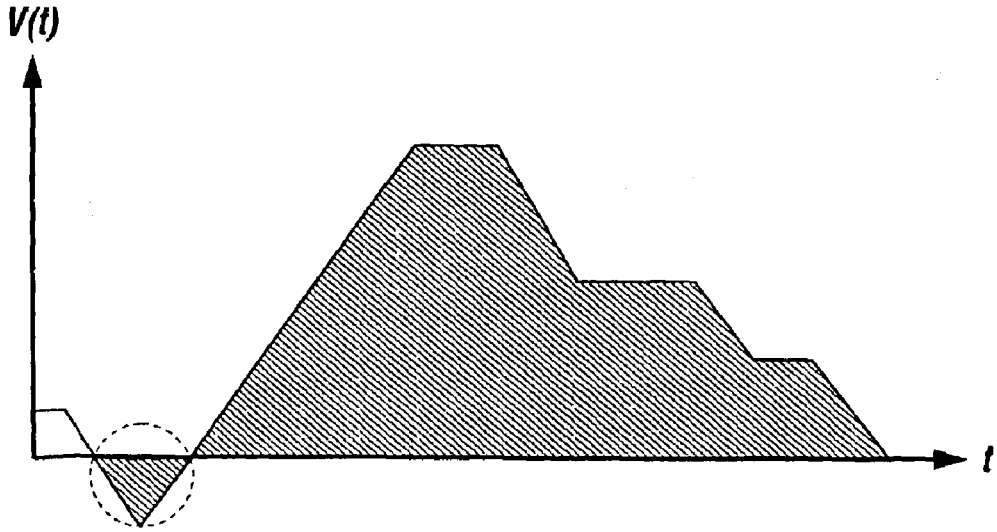
FIG. 9 illustrates a complex exemplary motion profile.
Figure 5:
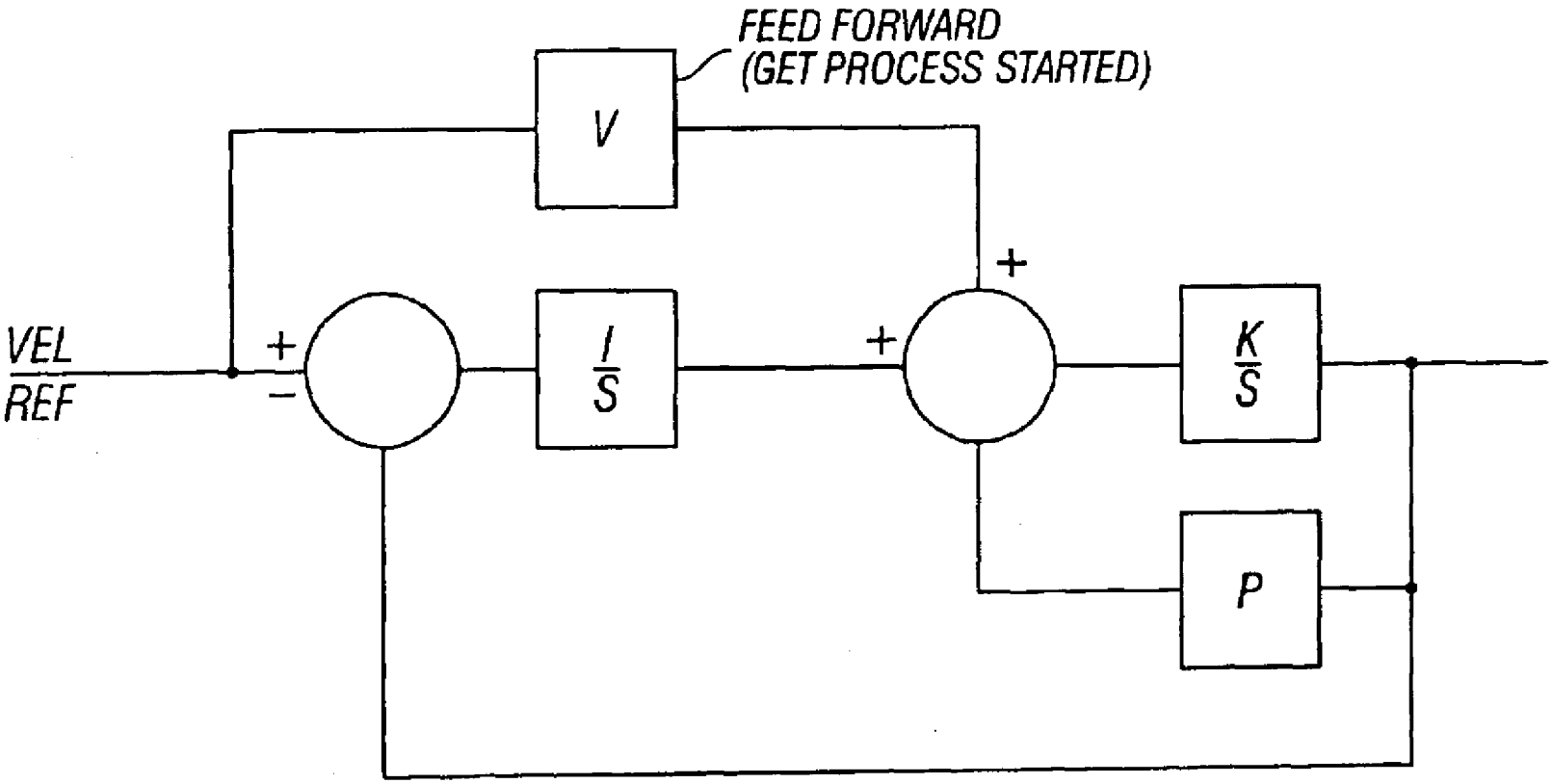
FIGS. 5 and 6 are block diagrams of closed-loop feedback processes.
Figure 8B:
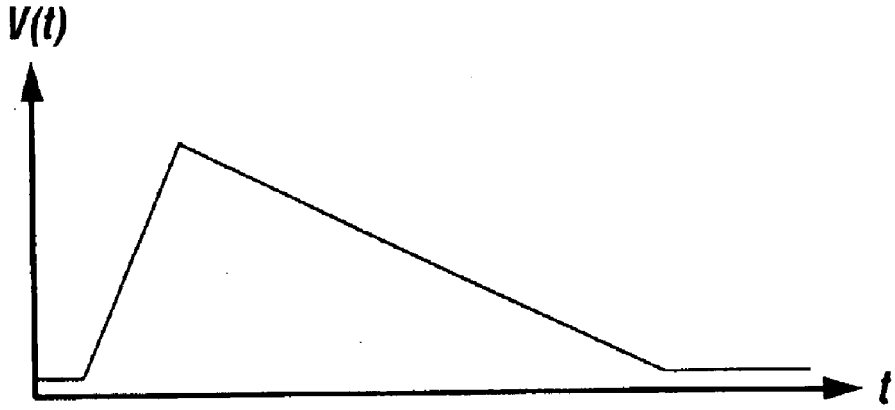
Figure 8C:
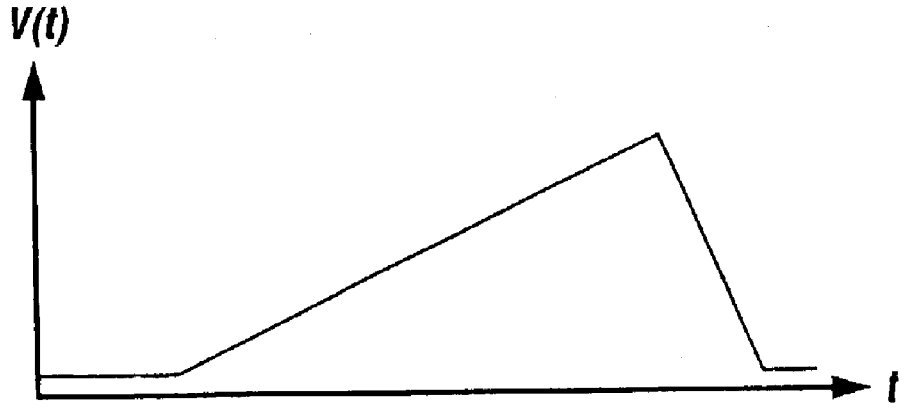

While the closed-loop position feedback process illustrated in FIG. 6 has a transfer function that defines somewhat simple, trapezoidal motion profiles, such as those illustrated in FIGS. 8A–8C, other closed-loop processes could be employed to define more complex motion profiles as required. For example, during a recloser opening operation, the contacts could be first driven with a negative force to break the weld that sometimes forms between the contacts before reversing the motion and driving the contacts apart, as exemplified by profile segment A in FIG. 9. This negative motion will crush the brittle weld and the driving mechanism will take up the slack of the mechanism in the closed position to store some momentum before the opening operation begins. This momentum will permit the mechanism to deliver some extra momentum via a hammer effect to drive the contacts apart. To achieve this, the switching operation control procedure may reference a look-up table to retrieve discrete velocity values during the course of the switching operation. This will enable the procedure to achieve a complex motion profile, such as the motion profile illustrated in FIG. 9. FIG. 5 shows an exemplary closed-loop process for accomplishing such a complex motion profile using both a feedback path and a feed-forward path.

In one implementation, the switch operation control procedure includes a number of different routines; each implemented in software using standard programming techniques. These routines are illustrated in the flowcharts of FIGS. 10A–10C.

Figure 10A:
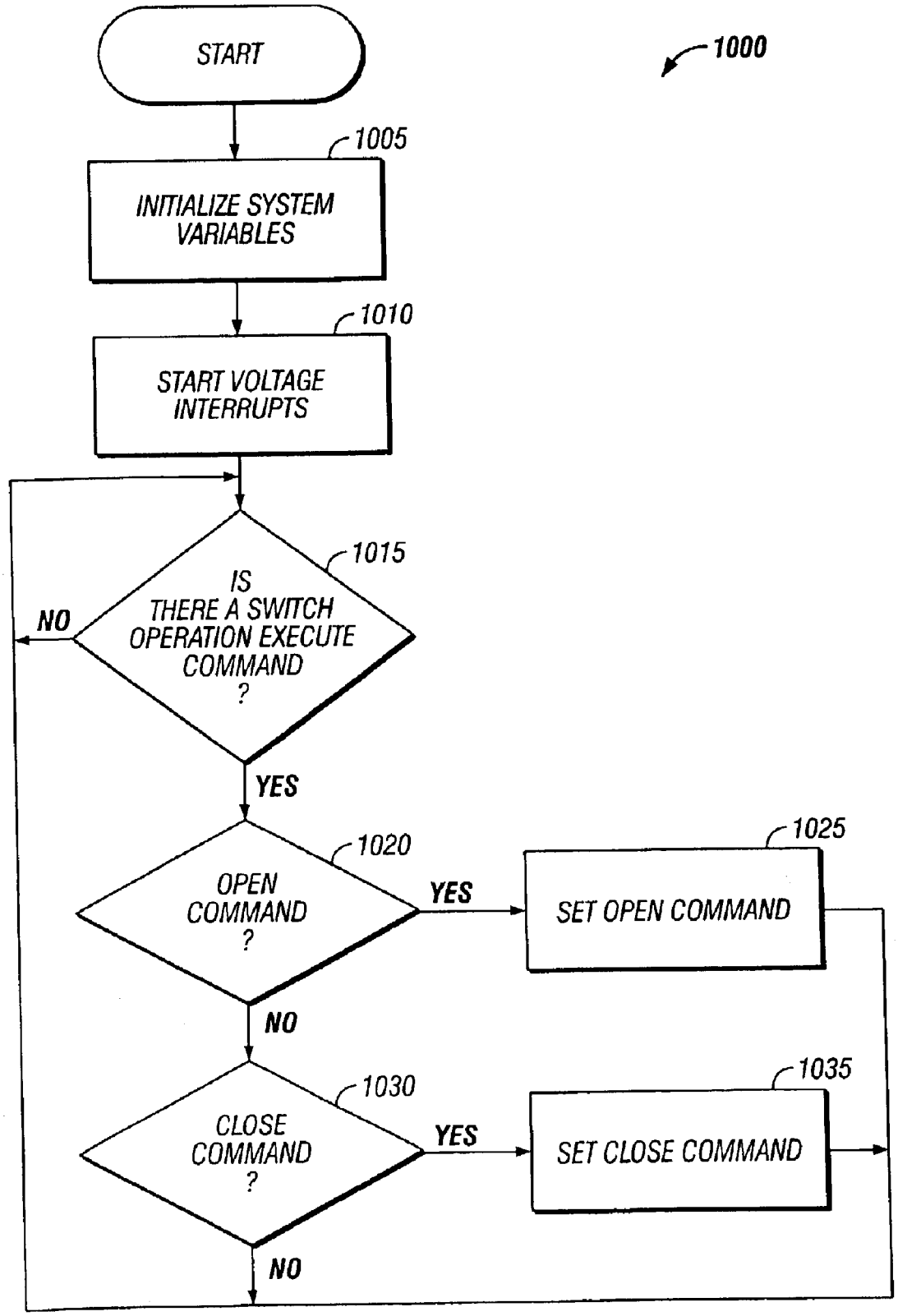
FIGS. 10A–10C illustrate a particular technique for implementing a switching operation control procedure.
Figure 10B:
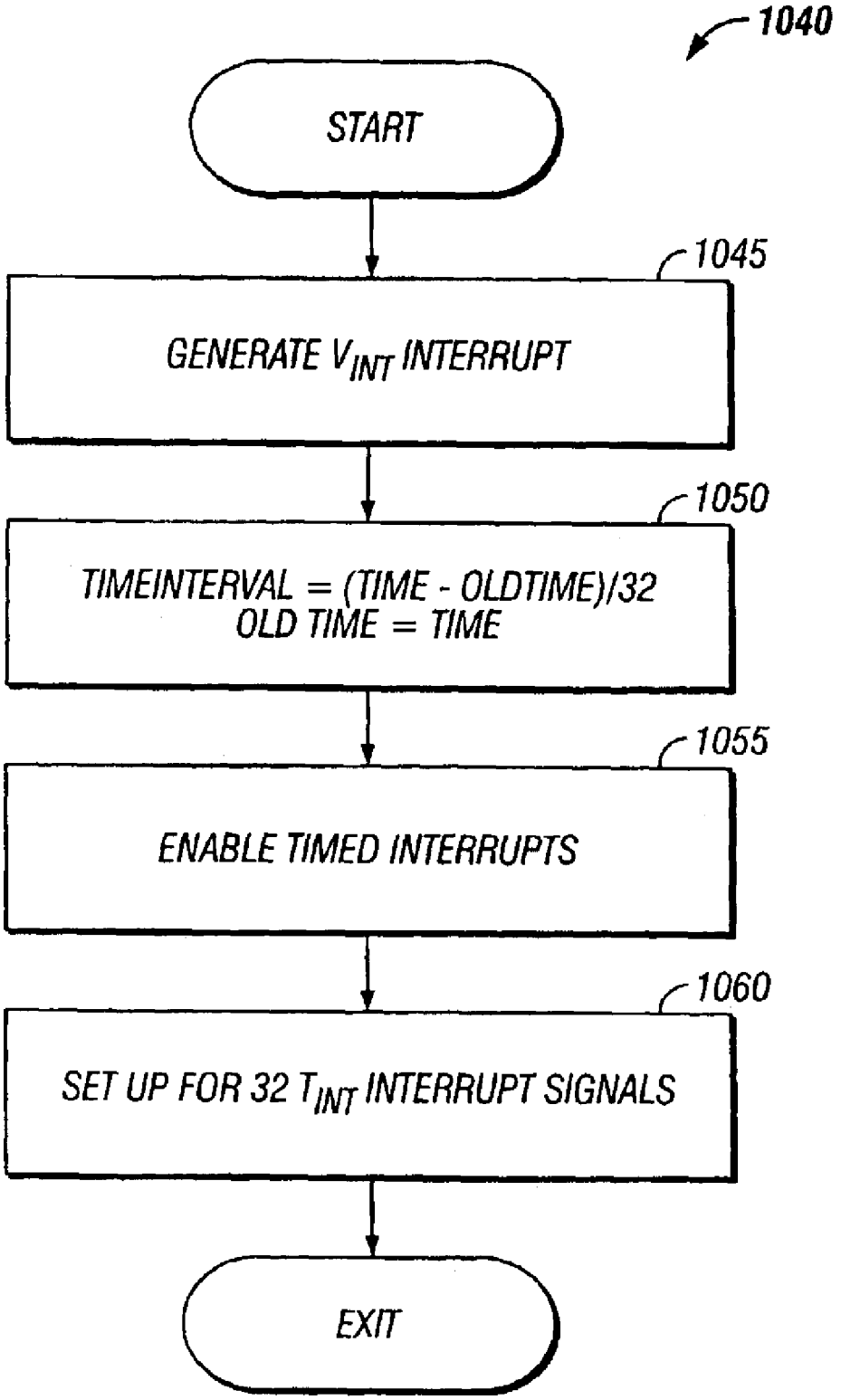
Figures 1, 10C:
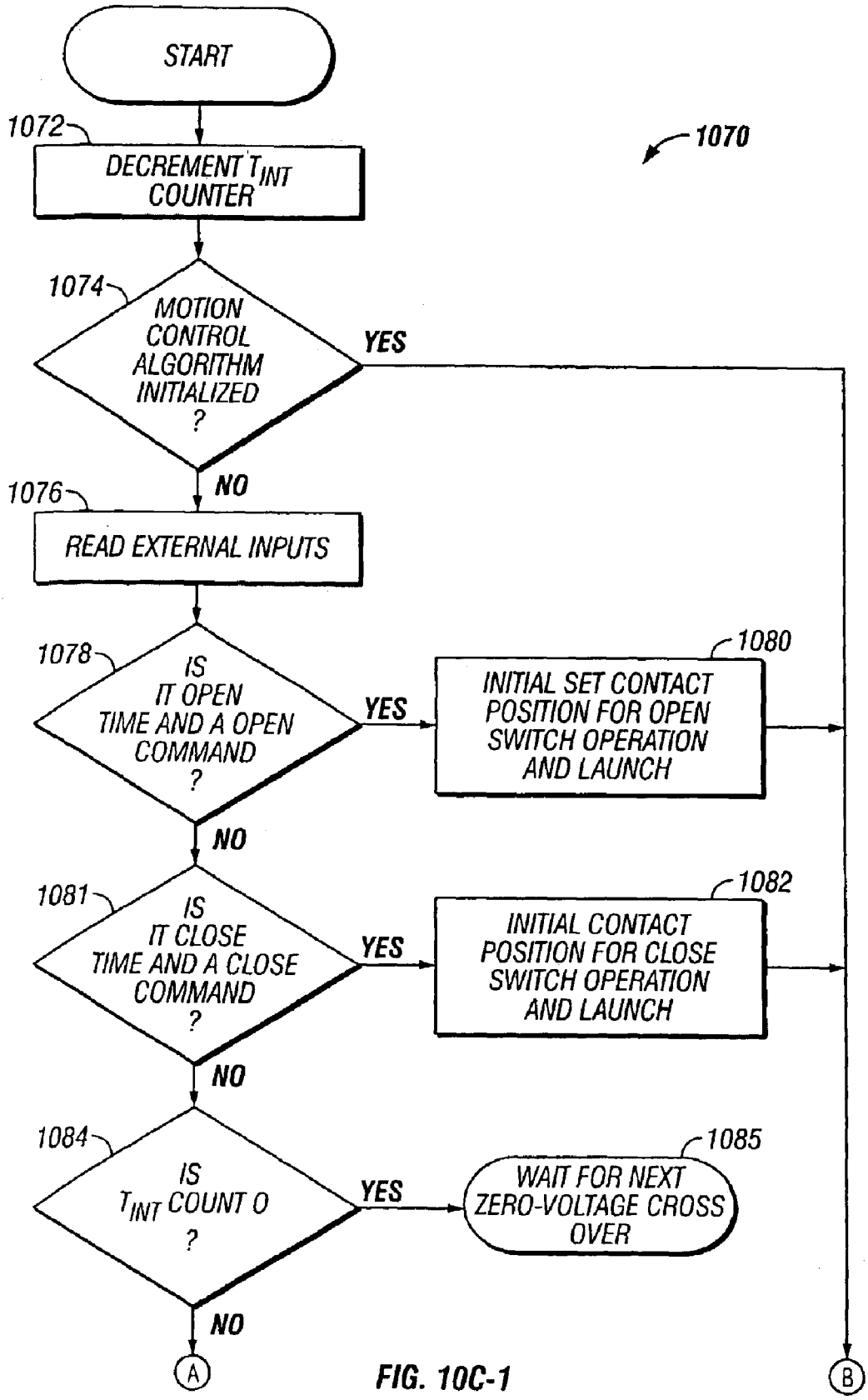
Figures 2, 10C:
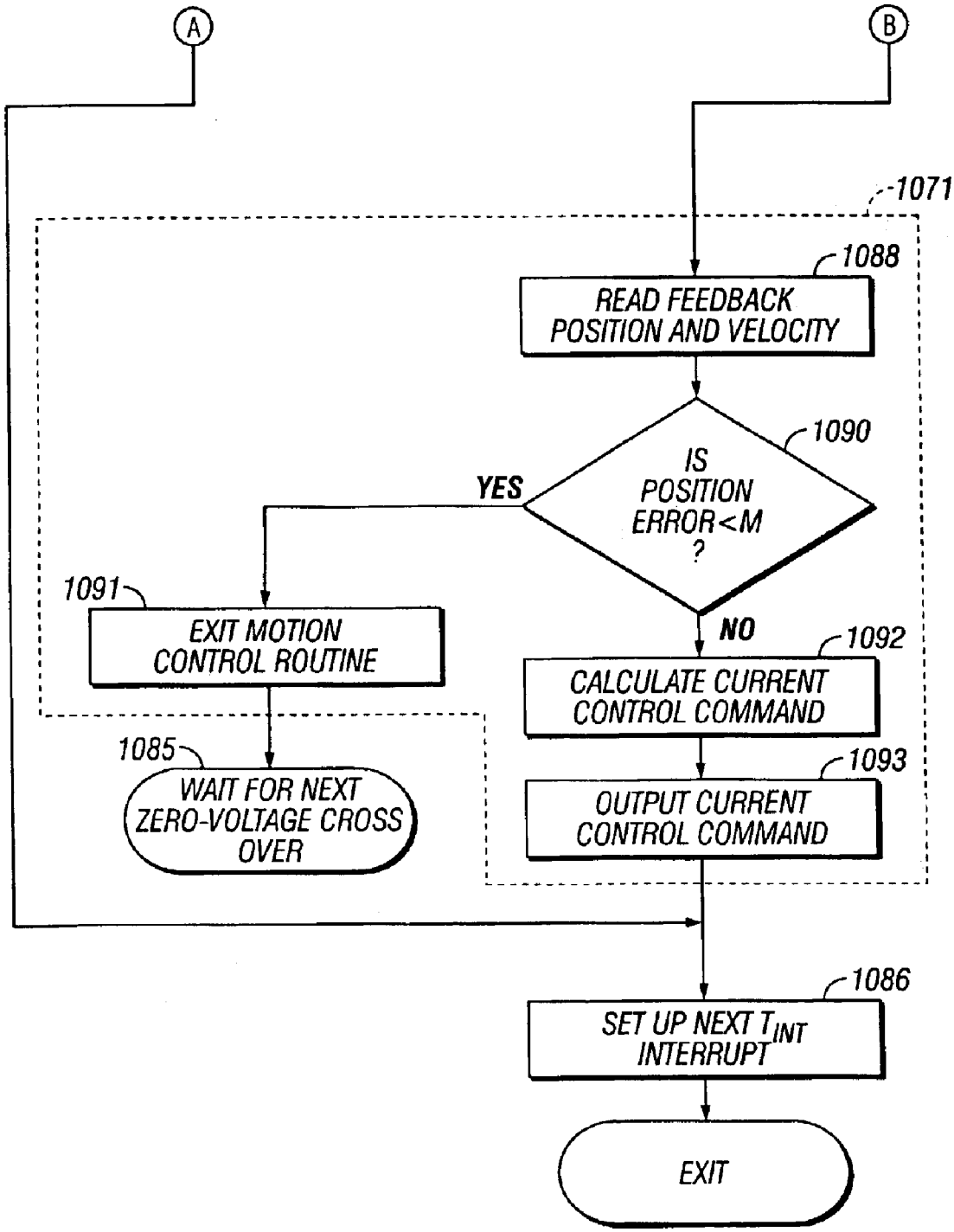

First, FIG. 10A illustrates a main start-up and initialization routine 1000 performed by the microprocessor 49. Microprocessor 49 begins the routine by initializing a number of system variables (step 1005). The microprocessor then enables the generation of $V_{INT}$ interrupt signals (step 1010 ). As explained previously, the $V_{INT}$ interrupt signals are generated as a function of the zero-voltage crossover timing pulses, which are produced by the AC voltage waveform analysis circuit 41.

After enabling the $V_{INT}$ interrupt signals, the microprocessor determines whether a switching operation execute command has been received, for example, through the capacitor switch control interface 43 (step 1015). If the microprocessor determines that no switching operation execute command has been received, the microprocessor remains in a loop in which it continues to check for the presence of a switching operation execute command.

If, however, the microprocessor determines that a switching operation execute command has been received, the microprocessor further determines whether the switching operation execute command is an OPEN switch command (step 1020). If the switching operation execute command is an OPEN switch command, microprocessor sets the appropriate switching operation status flag(s) to reflect the presence of an OPEN switch command (step 1025). If the switching operation execute command is not an OPEN switch command, the microprocessor determines whether the switching operation execute command is a CLOSE switch command (step 1030). If so, the microprocessor sets the appropriate switching operation status flag(s) to reflect the presence of a CLOSE switch command (step 1035). If neither an OPEN switch command nor a CLOSE switch command is present, the microprocessor continues to look for switching operation execute commands (step 1015). The microprocessor later employs the switching operation status flag(s) indicating the presence of an OPEN switch command or a CLOSE switch command in performing the timed interval $T_{INT}$ routine to invoke the motion control routine, as described in greater detail below.

Upon enabling the $V_{INT}$ interrupt signals (step 1010), the microprocessor 49 begins executing a zero-voltage interrupt routine 1040, as illustrated in FIG. 10B. The microprocessor begins the zero-voltage interrupt routine by generating a $V_{INT}$ interrupt signal (step 1045) when the microprocessor 49 receives a zero-voltage crossover timing pulse from the AC voltage waveform analysis circuit 41. The microprocessor then stores the clock time corresponding to the generation of the $V_{INT}$ interrupt signal as the system variable TIME. The microprocessor then determines the amount of time associated with the variable TIMEINTERVAL, which represents the length of time associated with the $T_{INT}$ intervals which separate each of the 32 $T_{INT}$ interrupt signals to be generated during the present half-cycle of the AC voltage waveform (step 1050). In one implementation, the variable TIMEINTERVAL is determined by the difference between the variable TIME, which represents the time of occurrence of the present zero-voltage crossover point, and a variable OLDTIME, which represents the time of occurrence of the previous zero-voltage crossover point. The difference between the variable TIME and the variable OLDTIME reflects the present half-cycle of the AC voltage waveform. The variable TIMEINTERVAL is then divided by 32, as each half-cycle of the AC voltage waveform is divided into 32 equally spaced intervals, during which a single $T_{INT}$ interrupt signal is generated, as explained above.

The microprocessor then enables the generation of $T_{INT}$ interrupt signals (step 1055). This involves loading an internal counter, referred to herein below as the timed interval counter, with the value associated with the variable TIMEINTERVAL. The timed interval counter immediately begins decrementing from the value associated with the variable TIMEINTERVAL. Each time the timed interval counter cycles to zero, a $T_{INT}$ interrupt signal is generated.

The microprocessor loads a second counter, herein referred to as the $T_{INT}$ counter, with the value 32 (step 1060). Each time a $T_{INT}$ interrupt signal is generated, the $T_{INT}$ counter is decremented by one. The purpose of the $T_{INT}$ counter will become more apparent from the description of the $T_{INT}$ interrupt routine below.

The $T_{INT}$ interrupt routine 1070, and the motion control routine 1071 are illustrated in FIG. 10C. When the timed interval counter decrements to zero, a $T_{INT}$ interrupt signal is generated. This, in turn, causes the $T_{INT}$ counter to be decremented by one (step 1072). Decrementing of the $T_{INT}$ counter precisely tracks the present position along the AC voltage waveform.

The microprocessor then checks a motion control status flag to determine whether the motion control routine has been launched (step 1074). Initially, the motion control routine status flag is reset, indicating that the motion control routine 1071 has not been launched. Under this condition, the microprocessor then checks the state of the aforementioned switching operation status flag(s) (step 1076), to determine whether an OPEN switch command or a CLOSE switch command is present. The state of the switching operation status flag(s) is set, if at all, by the main start-up and initialization routine 1000, steps 1020–1035, as shown in FIG. 10A.

The microprocessor then determines whether the switching operation status flag(s) indicate the presence of an OPEN switch command and whether it is the appropriate time (i.e., the appropriate timed interval along the AC voltage waveform) to initiate an open switch operation (step 1078). If both-of these conditions are met, the microprocessor launches the motion control routine 1071 for an OPEN switch operation (step 1080). Launching the motion control routine 1071 involves, among other things, loading an initial contact position (i.e., the total distance traveled by the contact(s) during the previous switching operation) and setting the motion control routine status flag, indicating that the motion control routine 1071 has been launched.

If the conditions are not met, the microprocessor determines whether the switching operation status flag(s) indicate the presence of a CLOSE switch command and whether it is the appropriate time (i.e., the appropriate timed interval along the AC voltage waveform) to initiate a close switch operation (step 1081). If both of these conditions are met, the microprocessor launches the motion control routine 1071 for a CLOSE switch operation (step 1082).

If the conditions are not met, the microprocessor determines whether the $T_{INT}$ counter has decremented to zero (step 1084). The $T_{INT}$ counter decrementing to zero indicates the end of the present half cycle of the AC voltage waveform. Accordingly, when $T_{INT}$ reaches zero, the microprocessor waits for the next zero-voltage crossover point and, consequently, the next $V_{INT}$ interrupt signal, which signifies the onset of the next half cycle of the AC voltage waveform (step 1085). However, if the $T_{INT}$ counter is not zero, the microprocessor sets up for the next $T_{INT}$ interrupt signal (step 1086).

After the microprocessor launches the motion control routine 1071 (step 1080 or step 1082), the microprocessor reads the present feedback position error and velocity from the feedback device 14 (step 1088). Initially, the feedback velocity is zero and the feedback position error is at its maximum value (i.e., equal to the initial contact position error value loaded during step 1080 or step 1082). Thereafter, the feedback position error and the velocity change as the contact 71 is moved during the switching operation.

Next, the microprocessor determines whether the position error is less than a predefined minimum value (step 1090). The purpose of this step is to determine whether the switching operation is essentially complete. If the position error is less than the predefined minimum value, the microprocessor exits motion control routine 1071, terminates the feedback process, and resets the various status flags (step 1091). The microprocessor then waits for the next zero-voltage crossover point and the generation of the next $V_{INT}$ interrupt signal (step 1085).

If the position error is not less than the predefined minimum value, the microprocessor calculates the current control signal (step 1092). The microprocessor then sends the calculated current control signal to the pulse width modulation unit (PWM) 47 (step 1093). As explained above, the current control signal is computed as a function of the feedback position error, velocity and the transfer function. The current control signal controls the amount of current flowing through the voice coil winding 10 and thus the force exerted to move contact 71. After sending the current control signal, the microprocessor sets up for the next $T_{INT}$ interrupt signal (step 1086) The microprocessor repeats the process until the switching operation is completed simultaneous to a zero-voltage crossover point.

The position and velocity sensing provided by the closed-loop feedback of the motion control enables implementation of diagnostic features that were not possible before in electrical switchgear. The microprocessor is able to register the contact's initial position and to monitor the contact's travel distance and speed throughout the life of the contact. Continuously monitoring these parameters can provide insight into wear on the contact and related components. This information is useful in determining residual contact life due to arc erosion and contact wear, and in the case of a vacuum interrupter, loss of the dielectric medium of vacuum in the interrupter. All of these factors may result in differences in either travel distance, velocity, or the desired motion profile. The microprocessor may be configured to shut down the system when forced with significant differences, or to communicate the problem through a utilities communications system so that maintenance may be scheduled immediately.

The interrupts generated to track voltage zeroes permit measurement of the frequency of the power system. If a measurement determines that a power generation system is approaching its frequency tolerance limit, the microprocessor could cause the switch to disconnect the particular power generation portion of a system from the rest of the system until the power frequency restabilizes, at which point the microprocessor would reconnect the two systems.

Figure 11:
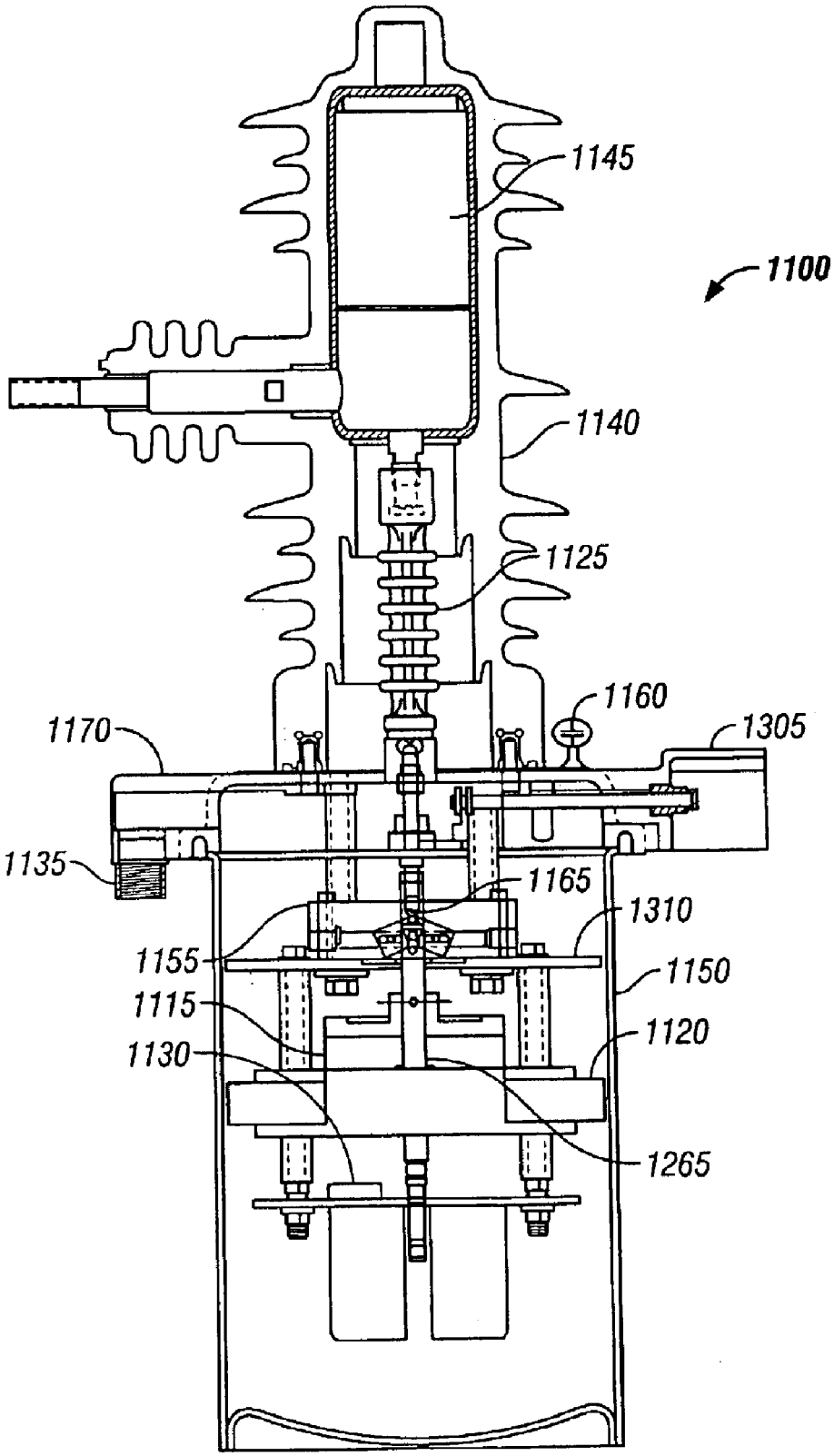
FIG. 11 illustrates a synchronous closing capacitor switch.

An implementation 1100 of the synchronous closing capacitor switch 2 of FIG. 2 is illustrated in FIG. 11. The switch 1100 includes a voice coil operating mechanism 1105 which includes a voice coil actuator 1120 and a voice coil winding 1115. The voice coil operating mechanism 1105 uses a permanent magnet in the voice coil actuator 1120 and the coil 1115 to produce a force on connected operating rods 1265, 1165, and 1125 (which are equivalent to operating rod 6 in FIGS. 2 and 3). The force is proportional to a current applied to the coil 1115. Unlike motor operators or solenoids, which do not provide dynamic motion control, the voice coil mechanism 1105 responds to instantaneous adjustments from a motion control circuit 1130. This dynamic feedback and regulation ensures synchronous operation, regardless of temperature, humidity, contact erosion, tolerances, and variability, and without ever needing manual adjustment.

Figure 12A:
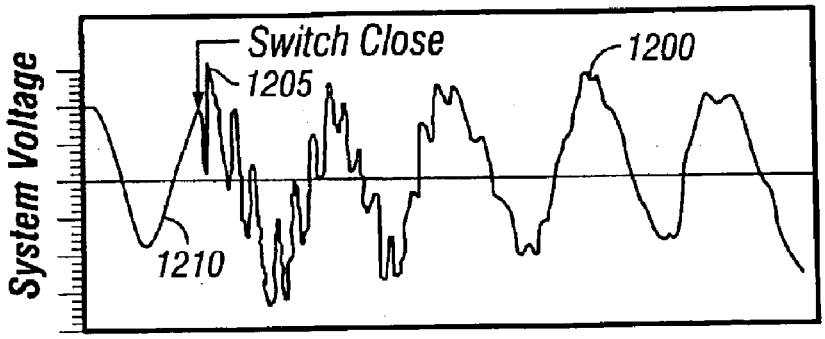
FIGS. 12A and 12B illustrate the AC voltage waveform for power distribution systems which, respectively, do not or do use a synchronous closing capacitor switch.

Referring to FIG. 12A, AC system voltage 1200 for an electrical distribution system varies with time. Capacitor bank switching in the capacitor switch 1100 may cause damaging overvoltage 1205 on the electrical distribution system. In particular, voltage transients may occur when a capacitor bank energizes, since capacitors in the capacitor bank attempt to immediately increase from the zero-voltage, de-energized condition to the current system voltage at the instant that switch contacts of the switch 1100 mate. In the process of achieving the voltage change, an overshoot equal to an amount of the attempted voltage change occurs.

This voltage surge 1205 can disrupt critical loads connected to the electrical distribution system. For example, variable speed drives, power electronics, and other sensitive devices employed by industrial customers require a power supply free of voltage transients or arcing. Furthermore, many home electronic products, such as computers and digital clocks, are sensitive to voltage transients. Arcing and transients may be avoided by closing the switch contacts on voltage zeroes 1210, so as to provide a voltage waveform comparable to the one shown in FIG. 12B.

The motion control circuit 1130 of the capacitor switch 1100 is programmed at the factory to close on voltage zeroes 1210 and never needs adjustment after it leaves the factory. The closed-loop position feedback device constantly monitors contact position and provides this information to the motion control circuit 1130. The control circuit 1130, which continually tracks zero voltage occurrences (for example point 1210 in FIGS. 12A and 12B), uses feedback information to close interrupter contacts precisely at voltage zeroes.

Figure 12B:
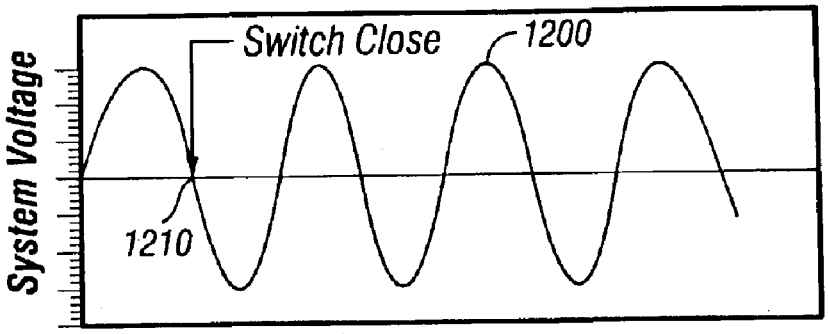

Referring to FIG. 12B, AC system voltage 1200 is plotted versus time in an electrical distribution system that uses the synchronous closing capacitor switch 1100. The synchronous closing capacitor switch 1100 ensures that system voltage 1200 is not adversely affected during capacitor switching operations. Synchronous closing is accomplished within a maximum time window of ±1.0 milliseconds of the AC system voltage zero 1210. This synchronization time window of closing the switch's contacts has been defined in the electric power industry to be equivalent to switchgear with closing resistors and has been found to minimize overvoltage 1205.

The motion control circuit 1130 of the capacitor switch 1100 interfaces to an external capacitor switch control via interface 1135 which is preferably a 5-pin or 6-pin connector. The connector 1135 is wired to provide an open signal, a close signal, a signal common, and a two-line, 120 Volts AC power input. A ground signal is provided by a head casting 1170 on which mounts the current interrupter housing 1140 and a tank 1150 (which houses the voice coil mechanism 1105, latching device 1155, and motion control circuit 1130) via a ground lug connection 1160. The capacitor switch 1100 is designed to operate in ambient temperatures from −40° C. to +65° C. and designed and tested to code C37.66-1969 where applicable.

Switching in the capacitor switch 1100 is accomplished by the current interrupter, which is in the form of a vacuum bottle 1145 encapsulated in a solid polymer that makes up the housing 1140. The movable contact that is attached to the current interchange 76 is located in the lower end of the vacuum bottle 1145. The current interchange 76 connects to the insulated operating rod 1125 that passes through a hole (not shown) in the head casting 1170 and allows connection to a stroke adjustment screw 1165. The stroke adjustment screw 1165 connects to the pull rod 1265 that couples to the latching device 1155 and the voice coil winding 1115. The capacitor switch 1100 is designed such that the head casting 1170 rotates independently from the tank 1150 to provide mounting flexibility.

Figure 13A:
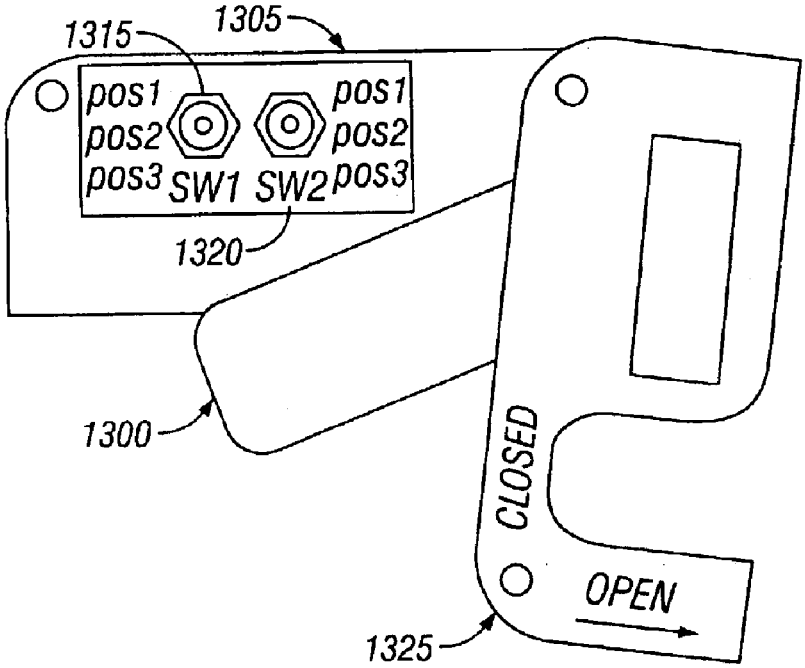

Referring also to FIG. 13A, visual open/close contact position indication is provided via an indicator 1300 under a hood 1305 of the capacitor switch 1100. Remote open/close control is accomplished via push buttons on an external control panel of an industry standard capacitor control that is connected to the capacitor switch 1100 via connector 1135 or by a manual trip mechanism (discussed below) that is also located under the hood 1305.

The latching device 1155 of FIG. 11 is an over-toggle type latch. However, the latching device 1155 may be any appropriate design, such as a canted spring, a ball plunger, a magnetic latch, or a bi-stable spring. The latching device 1155 must provide enough pressure to the switch contacts to minimize contact resistance. The break force of latching device 1155 must be greater than the desired contact pressure. The latching device 1155 must withstand the close and latch currents, and the latching device can help minimize or prevent contact bounce by damping it. The latching device 1155 is attached to the voice coil mechanism 1105 using a mounting plate 1310.

Two toggle switches 1315, 1320 are located under the hood 1305 and behind a nameplate 1325 on the capacitor switch 1100. The contact position indicator 1300, which indicates a relative position of the switch contacts must be set or pulled to OPEN before the toggle switches 1315, 1320 can be adjusted. The toggle switches 1315, 1320 are used to configure the capacitor switch close timing with respect to the power system configuration and the reference phase voltage that is input to the motion control circuit 1130. Knowledge of an electrical distribution system phase rotation is critical to proper installation and operation of the capacitor switch 1100.

Figure 13B:
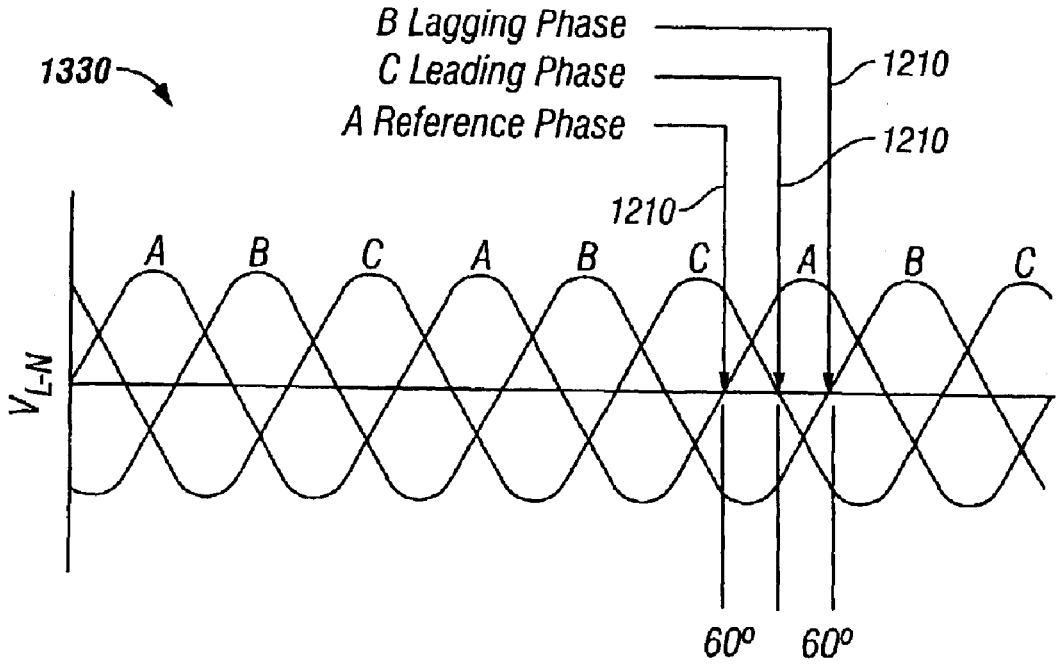
Figure 13C:
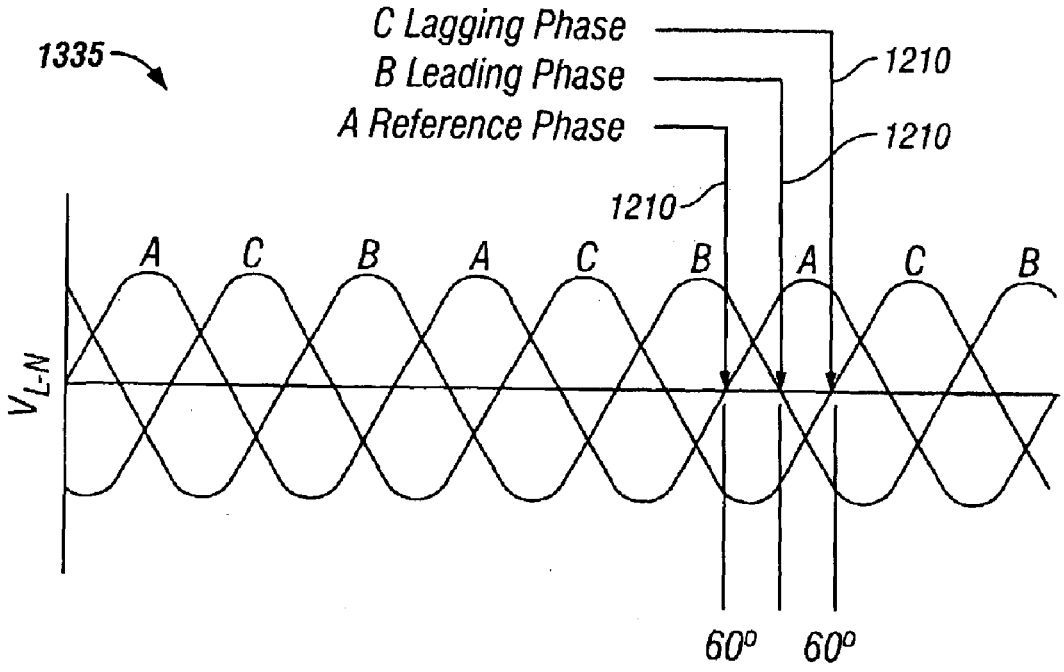

Referring also to FIGS. 13B and 13C, in a three-phase system (labeling the three phases A, B, and C), there are two possible rotations (that is, permutations) of the phases. For example, in a grounded-wye application, the first rotation 1330 is A-B-C (shown in FIG. 13B) and the second rotation 1335 is C-B-A (shown in FIG. 13C). Knowledge of the phase rotation is critical to the proper installation and operation of the capacitor switch 1100. The toggle switches 1315, 1320 on a switch 1100 are set depending on the phase application for that switch 1100.

Referring also to FIG. 13D, a table 1340 displays toggle switch settings (in a grounded-wye application) that depend on the phase on which the capacitor switch is used. The toggle position, also referred to as a shipping state, of the toggle switches 1315, 1320 is a second position (POS2) shown in FIG. 13A. When the synchronous capacitor switch 1100 is used on a reference phase, toggle switch 1315 is configured in a first position (POS1) and toggle switch 1320 is configured in a third position (POS3). When the synchronous capacitor switch 1100 is used on a leading phase (that is, a phase that lags the reference phase by 60°), toggle switches 1315 and 1320 are configured in the first position (POS1). When the synchronous capacitor switch 1100 is used on a lagging phase (that is, a phase that lags the reference phase by 120°), toggle switches 1315 and 1320 are configured in the third position (POS3). Switch setting are also provided for ungrounded applications and will be discussed later.

The input voltage powers the capacitor switch 1100 and is used as a reference synchronizing voltage. When applying the capacitor switch 1100 in a three-phase system 1330 or 1335, the reference synchronizing voltage may be provided from each phase independently, or from just one reference phase. If the individual synchronizing voltage is provided independently from each phase, then each synchronous capacitor switch is configured to close on its reference voltage zero point (for example, point 1210 in FIGS. 13B and 13C). When each capacitor switch 1100 closes independently at its respective phase's voltage zero point 1210, the first capacitor switch 1100 to close is connected to the reference phase. Then, the second capacitor switch 1100 to close is connected to a leading phase that lags the reference phase by 60°. Finally, the third capacitor switch 1100 to close is connected to a lagging phase that lags the reference phase by 120°. If just one reference phase voltage will be used for the system, then each capacitor switch 1100 must be appropriately configured.

The control circuit 1130 may fit inside the tank 1150 and mount under the voice coil/magnet assembly 1115, 1120. The control's circuit board includes the following sections shown in FIG. 4: the microprocessor 49, the dual voltage power supply 45, and the voltage zero cross detection circuit 41 which tracks the voltage zero 1210 of the phase system voltage 1200. The microprocessor implements a position detection procedure, which is used to track/control the vacuum bottle's contact position for motion control and to detect the switch's position. Closed-looped feedback, an essential part of the motion control circuit 1130, is provided by proportional-integral (PI) loops.

The motion control circuit 1130 can operate on 120 Volts AC (107 to 127 VAC) or various popular DC voltages. The power inputs are protected from voltage surges and the open/close signal input lines are optically isolated. The DC powered controls are designed for 3000 Volts peak voltage isolation and have an AC voltage input for voltage zero detection. Both the AC and DC input units have dual voltage power supplies. The first voltage level is PWM DC that powers the motion control circuit 1130 of the voice coil mechanism 1105 via a MOSFET Bridge. The second voltage level is 15 Volts DC that powers the electronics.

The control circuit 1130 has eight input connectors. The first connector is an external control cable from an industry standard capacitor control. The second connector is an internal standard RS-232 port with modifications for programming and bench top diagnostics. The third connector is an internal connection for the digital (for example, optical encoder) or analog position indicator (for example, a linear potentiometer or a LVDT). The fourth connector is the power connection to the voice coil mechanism 1105. The fifth connector is the connection to external switches. The sixth connector is the connection for voltage referencing from distribution transformers connected to the electrical power line. The last two connectors are for diagnostic checks.

The position sensor 44 has a dual function with this control circuit 1130. Its first function is to provide position feedback to the control circuit 1130. The sensor 44 is attached to the vacuum bottle's movable contact (71 shown in FIG. 3) to monitor its position. The contact's position is controlled in time via the power input to the voice coil mechanism 1105. This motion control of the contacts achieves the synchronized closing of the contacts at a voltage zero 1210.

The position sensor's second function is to measure an amount of contact wear. The vacuum bottle's contacts are designed to provide a certain amount of erosion, on the order of about 0.0625–0.125 inches, due to the arc interruption process. A low resolution position sensor 44 may be used for the motion control, but a higher resolution position sensor 44 is needed to measure the amount of contact erosion to a required degree of accuracy. A high resolution position sensor 44 must be able to accurately read less than one thousandth of an inch. Accuracy of the position sensor 44 is related to cost and thus there is a compromise of cost and accuracy in deciding the best position sensor 44 for the switch application.

There are two options for feeding the reference voltage to the motion control circuit 1130. The first and simplest is to use the input voltage that powers the amplifier in the PWM unit 47. This method can be a little inaccurate but can be used where the phase rotation is a consistent 120 degrees. The second is to feed the motion control circuit 1130 a reference voltage from a potential transformer (not shown, but which would be connected in parallel with the primary of the distribution transformer 1400 shown, for example, in FIGS. 14A and 14B) that is on the same phase as the synchronous switch 1100.

FIGS. 14A and 14B show two examples of applying the synchronous capacitor switch 1100 in a three-phase operation (with each phase represented by A, B, and C) for grounded-wye and ungrounded-wye capacitor banks, 1405 and 1410, respectively.

In FIG. 14A, the distribution transformer 1400 is configured on all three phases A, B, and C in the phase rotation sequence. The primary connection of each distribution transformer 1400 must be phase to ground. Each capacitor switch 1100 is configured to close on its reference voltage zero point 1210.

In FIG. 14B, the distribution transformer 1400 is configured on a single phase (for example, C) in the phase rotation sequence and the primary connection of the distribution transformer 1400 is phase to ground. Phase C, which energizes the distribution transformer 1400, is the last to close in the phase rotation. The two phases (A and B) not connected to the distribution transformer 1400 close simultaneously, followed by phase C connected to the transformer 1400. The first two phases lag the reference voltage-zero point by 90°, and the third phase lags the reference voltage point by 180° (the next voltage-zero point for the reference waveform). Two capacitor switches are configured for a 90° lag. Toggle switch 1315 is set to POS3 and toggle switch 1320 is set to POS2. The third capacitor switch is configured for 180° lag. Toggle switch 1315 is set to POS3 and toggle switch 1320 is set to POS1.

Switch timings may be adjusted by the microprocessor 49 to yield the proper electrical degree phase displacement from the first phase in the rotation. Adjusting the timings from the first phase takes into account the different timings for different system configurations (a couple of which were shown in FIGS. 14A and 14B). The timing setup could be done in the factory or in the field by configuring each device's switch settings. This essentially covers all the switch settings, but not all application scenarios. In summary, the switch settings depend on the power system configuration, the transformer's connection to the power system, and the phase rotation.

The microprocessor 49 contains and controls all functionality of the switch 1100. The microprocessor 49 performs several important tasks. For example, after the capacitor switch 1100 is powered-up, the microprocessor 49 performs system initializations and checks. Normally, the source voltage is constantly monitored by the microprocessor 49 for close timing. When both source and load voltages are monitored by the switch 1100, the microprocessor 49 will time the switch 1100 to close at a differential of zero volts across the switch 1100 (called point on wave switching).

The microprocessor 49 also performs various diagnostic duties which may be disabled if desired. For example, the microprocessor 49 monitors and checks the AC system's phase voltage 1200 for zero crossing consistency before allowing a next operation. Furthermore, the microprocessor 49 checks for a presence of the system voltage 1200. If the microprocessor 49 detects no voltage, it may initiate an opening of the switch contacts if power is lost for more than a preset time. If the voltage level of the high current power supply dips below a minimum threshold level, the microprocessor 49 could command the switch contacts to open immediately.

The microprocessor 49 also monitors the switch contacts relative position. Additionally, the microprocessor 49 scans the open/close inputs. If an input signal is detected, the microprocessor 49 determines if the signal is a legitimate signal and not noise. If a valid request is detected from the input signal (that is, the signal is legitimate), the microprocessor 49 determines if the request can be achieved with the switch's movable contact in its present position. If so, the microprocessor 49 initiates an open/close motion sequence. During an open/close motion sequence, the microprocessor 49 sets a travel distance of the switch's movable contact, determines the motion start time to open/close synchronously, executes an open/close motion profile, monitors the switch contacts actual motion profile, stores the values, and then, at the end of contact travel, monitors the final contact position. At the finish of a motion sequence, the microprocessor 49 examines, analyzes, and adjusts the motion profile so that the switch's operation is still within synchronous tolerances for the next operation. If the microprocessor 49 detects excessive distance errors which cannot be adjusted within two sample periods, then the microprocessor 49 adjusts a velocity profile of the movable contact to achieve this change.

The microprocessor 49 monitors and detects the full travel position of the movable contact. Monitoring the contact's full travel position permits electronic control of the positioning of switch contacts and thus eliminates contact rebound in addition to preventing unnecessary impacts to the housing.

The microprocessor 49 tracks the switch's number of operations and stores this number in memory.

The synchronous closing capacitor switch 1100 may be applied in any application that requires a switching mechanism. For example, the capacitor switch 1100 may be used in transformer switching. When a transformer is deenergized, a remanence or residual flux is left in its magnetic core. To re-energize the transformer with the minimum disturbance to the power system, the voltage polarity on which the transformer was opened must be known. Then when the transformer is reenergized, the closing should be done such that the opposite voltage polarity from the opening should be applied to cancel the leftover remanence in the core. This procedure minimizes the transient disturbances that can occur to the power system.

As another example, the capacitor switch 1100 may be used in frequency switching. A local utility company wants to be assured that a voltage frequency supplied by a co-generation power company matches their required 60 Hz frequency. If the supplied frequency is out of a predetermined tolerance, the utility company preferably disconnects the co-generation company until their frequency is corrected or stabilized. The microprocessor 49 may be used in this application to provide very precise timing of events and/or measurements needed for frequency switching.

As a further example, the capacitor switch 1100 may be used in recloser applications. It could be programmed to close at a voltage zero point and open at a current zero point. Or, custom timing characteristics could be programmed by factory personnel for various special applications by utilities. Likewise, custom travel profiles could be programmed to obtain maximum performance characteristics from the vacuum bottles.

The bi-stable over-toggle latching device 1155 shown in FIG. 11 was designed for controlling the operating rod 1125 (equivalent to operating rod 6 in FIGS. 2 and 3) that drives the movable contact (71 shown in FIG. 3) in the vacuum bottle 1145. Although the latching device 1155 was designed for a vacuum application, it could be implemented in other switchgear devices that use interruption/insulation mediums like SF6 or oil.

The bi-stable over-toggle latching device 1155 holds the contacts of the switch 1100 in either an open position or a closed position. The latching device 1155 controls movement of the operating rod 1125 which couples the movable contact to a center shaft 1265 of the latching device 1155. The latching device 1155 provides constant pressure to the switch contacts when the switch 1100 is closed. The level of contact pressure is determined by two factors: 1) a force required to keep contact resistance at a low level and 2) a force required to prevent the contacts from blowing open during a high current transient or fault conditions. A suitable level of contact resistance is determined by temperature rises during heat run tests and tests to determine and prevent contact resistive welding during fault conditions. Standards dictate a momentary current withstand level that corresponds to the switch's ampere and voltage rating. This assures that the switch 1100 will stay closed during a high current transient or voltage surge (for example, 1205 in FIG. 12A). The switch 1100 must be tested to this condition and must pass the test to be certified.

Figure 15A:
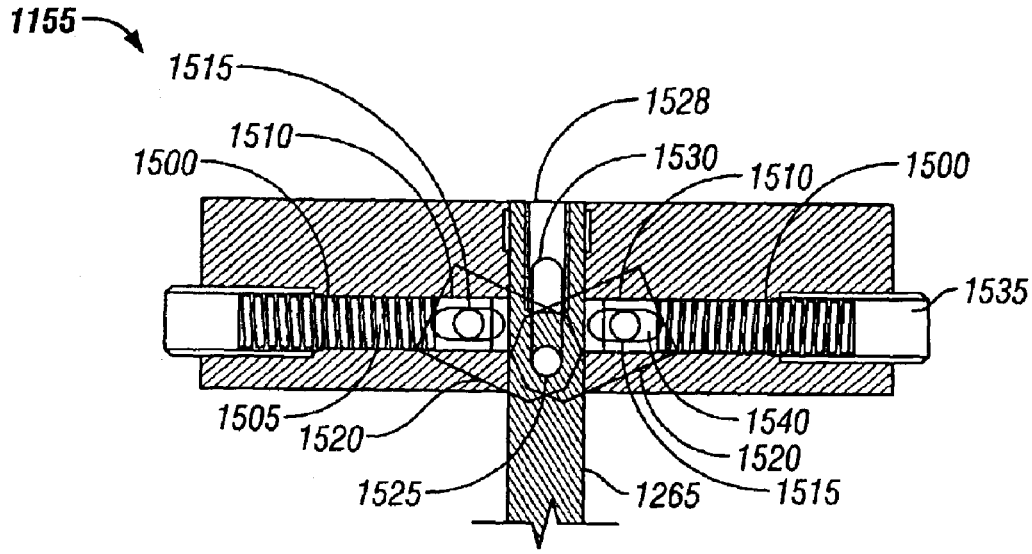
FIGS. 15A–15C illustrate a bi-stable over-toggle latch that may be used in the synchronous closing capacitor switch.
Figure 15B:
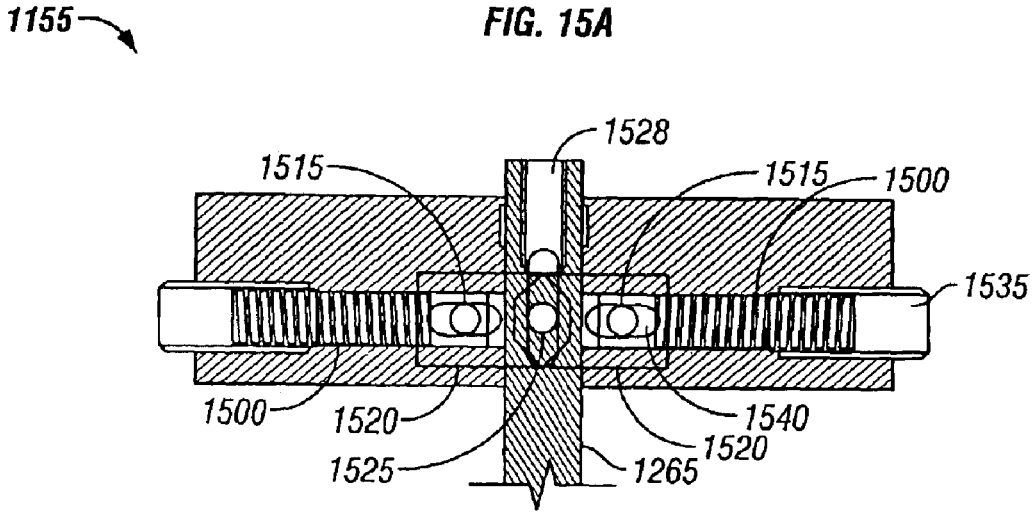
Figure 15C:
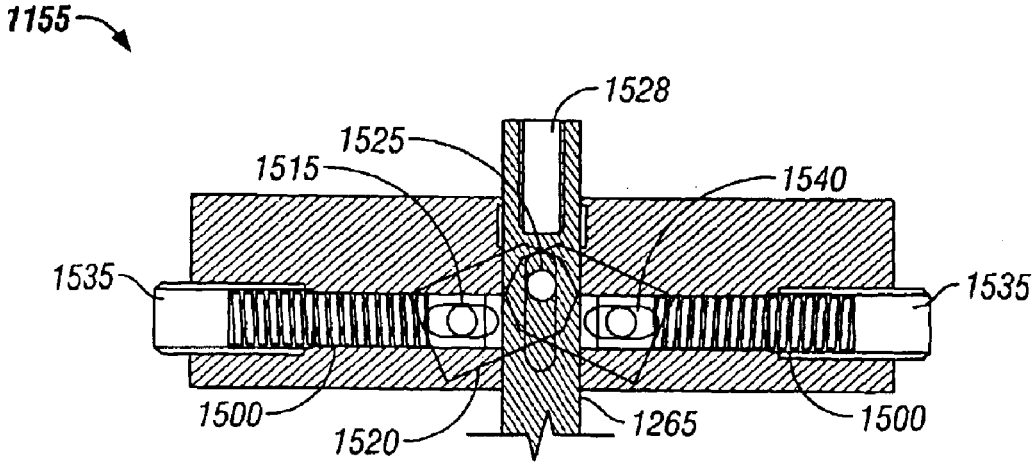

Referring also to FIGS. 15A–15C, the over-toggle latching device 1155 has three distinct positions corresponding to the relative positions of the switch contacts: open (FIG. 15A), toggle (FIG. 15B), and closed (FIG. 15C). In the open position, the operating rod 1125 is pulled downward by the center shaft 1265 and thus retracts movable contact from the stationary contact. The switch contacts, when apart, are separated by a dielectric medium which forms a gap. This gap prevents the switch contacts from touching and interrupts or prevents current flow. The latching device 1155 holds the switch contacts open until the switch 1100 is commanded to close. The latching device 1155 achieves this via compression springs 1500 (movable inside a chamber 1505 of the latching device 1155), which exert forces on associated pistons 1510. Each piston includes a pin 1515 positioned in a transverse direction from a side of the piston 1510. The force to the pistons 1510 transfers through linkages 1520 that couple the pistons 1510 and associated pins 1515 to a center pin 1525 which is attached to the center shaft 1265. The center shaft 1265 connects to the stroke adjustment screw 1165 through a tapped hole 1528. The stroke adjustment screw 1165 couples to the insulated operating rod 1125 which in turn connects to the movable contact of the vacuum bottle 1145.

Figure 16A:
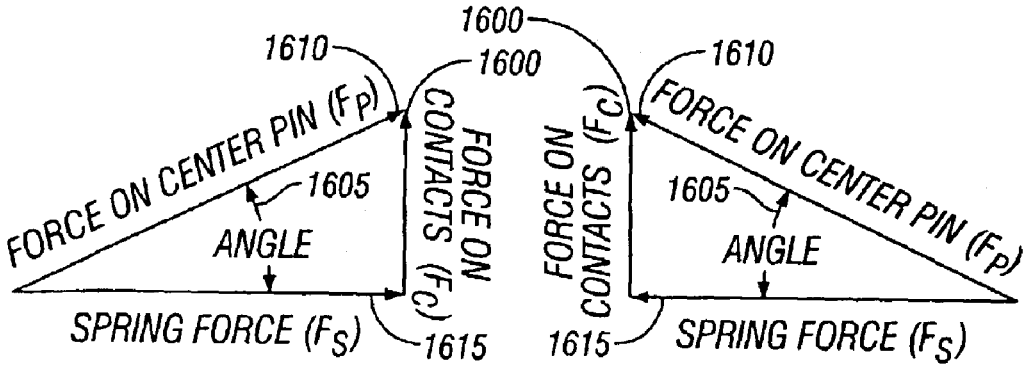
FIGS. 16A and 16B illustrate forces applied to components of the latch.
Figure 16B:
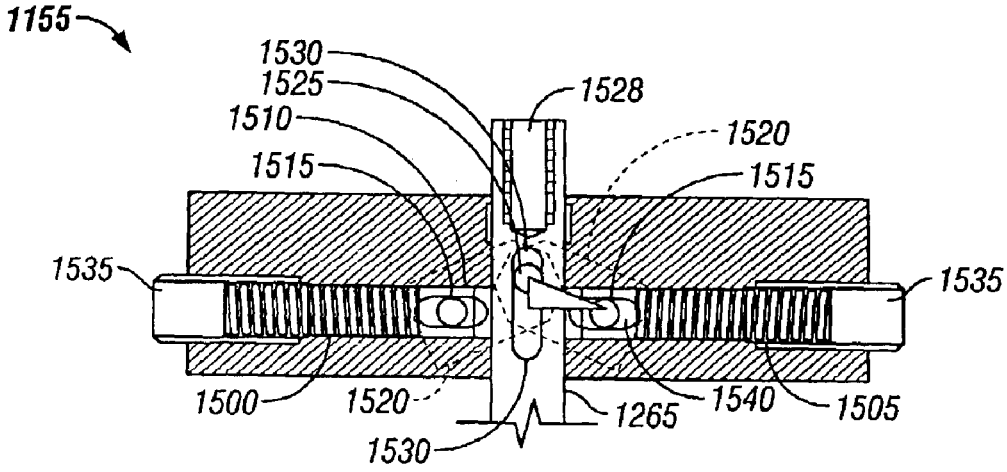

Referring also to FIGS. 16A and 16B, a vertical latch force 1600 is dependent on an angle 1605 between a force 1610 on the center pin from the linkage 1520 and a spring force 1615 that is orthogonal to the vertical direction. When the latch linkages 1520 are horizontal (that is, at the toggle position in FIG. 15B), the force 1600 in the vertical direction is zero. The force on the center pin 1525 is equal to the spring force 1615. The toggle position, however, is an unstable equilibrium position that will be disrupted by a small vertical upset. Once the latch linkages 1520 are past the horizontal position, in either direction, the vertical force 1600 increases and pushes the linkages 1520 and shaft 1265 to a maximum allowed travel position (shown in FIGS. 15A and 15C). In the open position, the center latch pin 1525 rests against a bottom of a vertical slot 1530 formed in the latching device 1155. In the closed position, the switch contacts provide a physical stop for the latching device 1155. The open and closed positions are stable equilibrium latch positions; thus, the latching device 1155 does not move until the switch 1100 is commanded to move.

When the switch 1100 is commanded to close, the switch operates with enough force to overcome the force exerted by the latching device 1155 and to accelerate the shaft 1265 past the toggle position to the closed position (shown in FIG. 15C). In the closed position, the electrical switch contacts touch each other and allow current to flow from the source side terminal (77 in FIG. 3) to the load side terminal. The latching device 1155 applies contact pressure to the switch contacts to hold them closed until the switch 1100 is commanded to open. The vertical contact pressure is related to the horizontal spring force 1615 by the tangent of the angle 1605 created between the linkage 1520 and horizontal as illustrated in FIG. 16A. The vertical slot 1530 in the latching device 1155 is longer than needed in the closed direction to allow the spring force 1615 to transfer to the switch contacts and not, for example, to the slot 1530. The extra length in the slot 1530 also allows for contact erosion, mechanical wear and temperature effects without compromising the function of the latching device 1155.

The bi-stable over-toggle latching device 1155 can be designed for a large range of contact forces and stroke lengths that correspond to a distance the shaft 1265 can travel. The latching device 1155 can also be designed so that the force settings are adjustable with set screws 1535 or fixed with a retainer (not shown) to hold the springs 1500 at a set compressed length, in the spring chambers of the latching device 1155. For the adjustable latch, the force setting can be checked and calibrated to a set force level. Calibration is done using a force gauge attached to the center shaft 1265. The force gauge pushes down on the shaft 1265 to measure the attainable output force level. Adjustments are made by turning the set screw inward by the same amount on each side of the latching device 1155 to raise the force, and outward to lower the force.

The vertical slot 1530 in the latching device 1155 also provides some alignment and prevents the switch contacts or moving parts from twisting to thereby increase the interrupter's mechanical life. The contact pressure increases as the switch contacts erode or the switch 1100 wears. The increase in the force is a unique design feature of this latching device and somewhat contrary to other latches as they experience wear.

Horizontal slots or oversized holes 1540 in which the piston pins 1515 move are designed to be slightly longer than the travel excursion that the springs 1500 go through when the latching device 1155 is operated and changes to its final position. The extra length prevents the latching device 1155 from stopping short, thus resulting in a loss of spring pressure being transferred to the center shaft 1265.

Figure 17A:
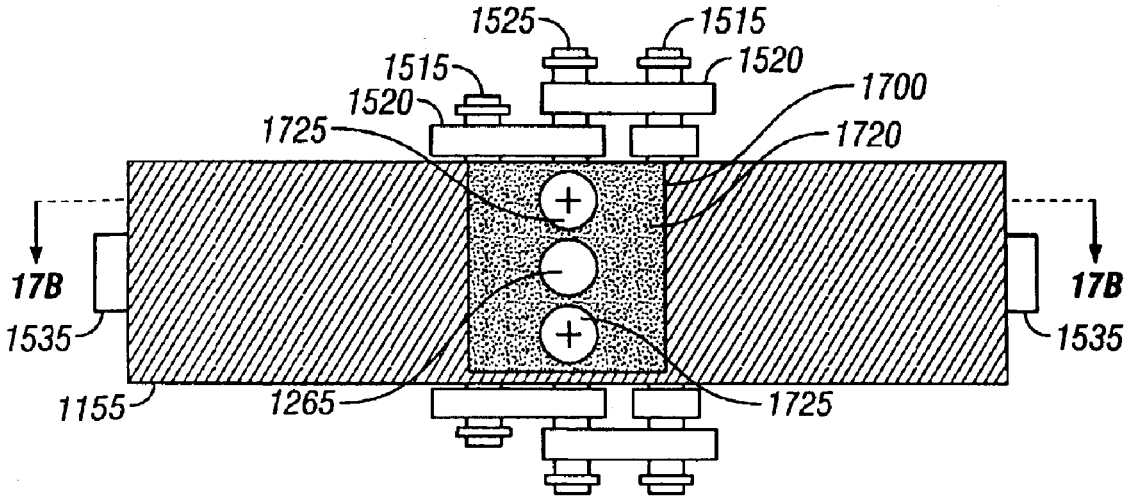
FIGS. 17A and 17B illustrate the latch using a shock-absorbing system.
Figure 17B:
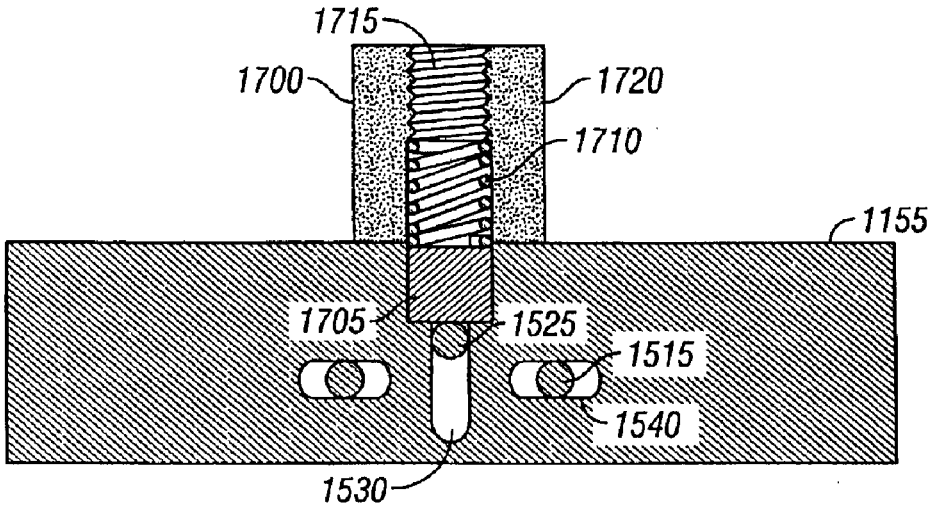

Referring also to FIGS. 17A and 17B, a shock absorbing system 1700 may be added to the latching device 1155. FIG. 17A shows a top view of the latching device 1155 with the shock absorbing system 1700 and FIG. 17B shows a side view through the section 17B—17B of FIG. 17A. The shock absorbing system 1700 may be incorporated onto the top, bottom, or both top and bottom of the latching device 1155. The system 1700 comprises a piston 1705, a spring 1710, and a set screw 1715 which are contained in a separate small housing 1720 that attaches to the top or the bottom of the latching device 1155. The shock absorbing system 1700 dampens and prevents contact bounce at the end of the switch's open or close operation. A hole 1725 is drilled in the latching device 1155 that aligns with the center pin 1525. The piston 1705 rides in the hole 1725 and contacts the center pin 1525. Behind the piston 1705 is the compressed spring 1710. The amount of spring compression may be adjusted with the set screw 1715 or it may be fixed. Adjustment of the set screw 1715 permits an adjustment in an amount of dampening needed for each latch application. The shock absorbing system 1700 may be used in the open position, the closed position, or both positions if desired. Furthermore, a piston, spring, set screw combination may be used on both sides of the center shaft 1265.

The over-toggle latching device 1155 was designed for a set of contacts used in a single-phase application. However, in an alternate embodiment, a larger latch design could handle each phase's set of contacts in a parallel fashion for a poly-phase application.

The over-toggle latching device 1155 was designed to be symmetrical about the horizontal, toggle position. In an alternate embodiment, the latching device 1155 may be designed asymmetrically about the toggle position.

Figure 18A:
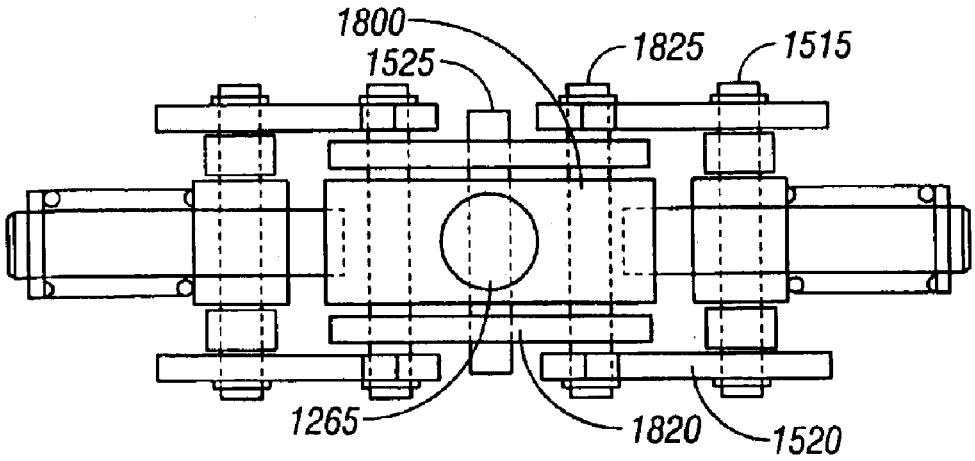
FIGS. 18A and 18B illustrate a tri-stable over-toggle latch that is modified from the latch of FIGS. 15A–15C.
Figure 18B:
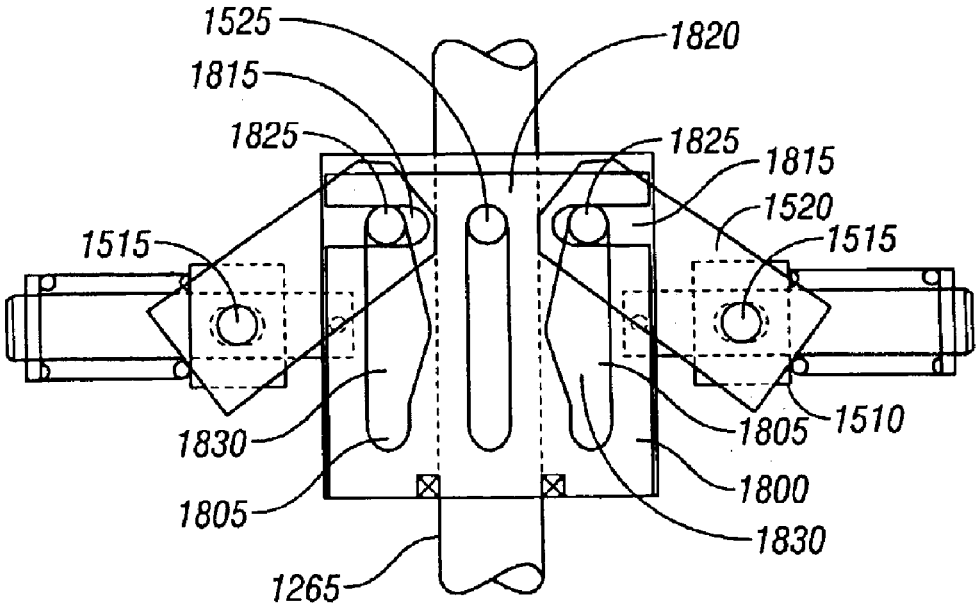

In yet another embodiment, the latching device 1155 may be slightly modified and designed for a three position or tri-stable over-toggle latching device 1800 as shown in FIGS. 18A and 18B. FIG. 18A is a top view of the tri-stable latching device 1800 and FIG. 18B is a side sectional view of the tri-stable latching device 1800 of FIG. 18A. The tri-stable latching device 1800 comprises two additional asymmetric slots 1805 and two open slots 1815. The asymmetric slots 1805 are parallel to the vertical slot 1530. The two open slots 1815 are orthogonal to the vertical slot 1530 and are formed on another linkage 1820 which couples the center pin 1525 to two side pins 1825 that slide through the asymmetric slots 1805. In the center or the toggle position, the springs 1500 push and hold the side linkage pins 1825 into an indent area 1830 formed in the asymmetrical slots 1805. This center position, unlike the toggle position of FIG. 15B, is a stable equilibrium point that prevents the center shaft 1265 from moving. Thus, the latching device 1800 provides three stable states (that is, open, close, and center). Because of this, latching device 1800 is versatile and is therefore designed for multiple applications in various devices with different insulating mediums.

The latching device 1155 may incorporate any number of pistons and linkages arranged around the shaft 1265. Furthermore, the piston/spring (1510, 1500) assembly may be positioned along any axis that is not parallel to the shaft. Such an arrangement could be used to provide an asymmetrical latching device that favors one latch position over another.

Figure 19:
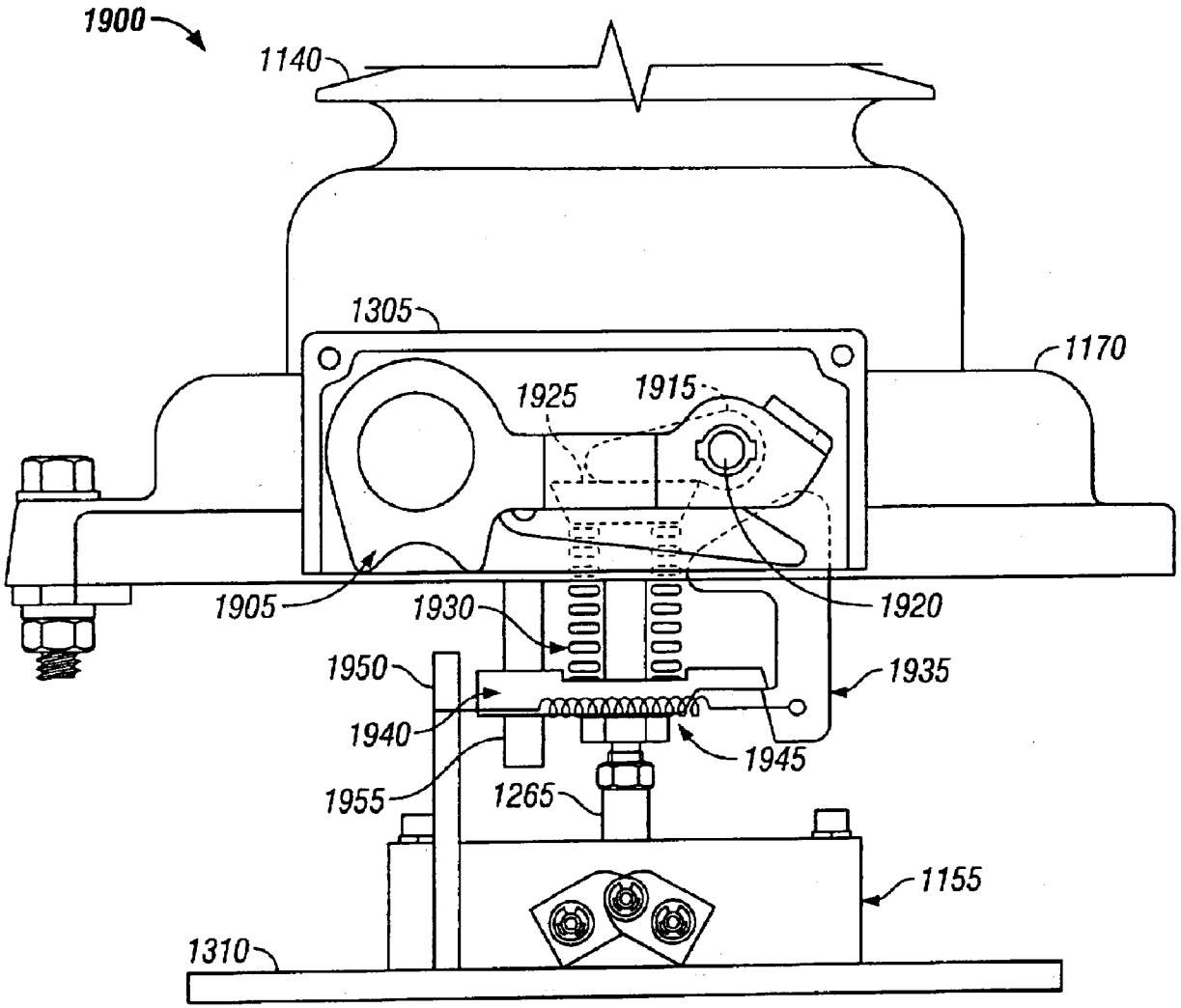
FIG. 19 illustrates a manual trip mechanism that may be used in the synchronous closing capacitor switch of FIG. 11.

Referring also to FIG. 19, the capacitor switch 1100 may incorporate a mechanical trip mechanism 1900 to provide an independent method of manually opening the switch contacts. The mechanical trip mechanism 1900 does not operate under electrical control, and, therefore, may be used when electrical power is deficient. Furthermore, the mechanical trip mechanism 1900, if left alone, does not interfere with normal electrical operation of the capacitor switch 1100. Thus, the mechanical trip mechanism 1900 may be used in the event of an emergency. For example, switch contacts may be opened even if the motion control circuit 1130 fails to open the capacitor switch 1100 electrically.

The mechanical trip mechanism 1900 is activated by pulling a handle 1905 that is positioned under the hood 1305 that is on the side of the head casting 1170. When the handle 1905 is pulled, the mechanical trip mechanism 1900 opens the switch contacts fast enough to clear the power system voltage and avoid a restrike.

The handle 1905 couples to a trip lever 1915 such that counterclockwise rotation of the handle 1905 about a trip pivot 1920 causes corresponding rotation of the trip lever 1915 about the trip pivot 1920. Once the trip lever 1915 begins rotating, it remains in contact with a trip plunger 1925. The trip plunger 1925 supplies a pressure to a trip compression spring 1930 and, beyond a threshold position, supplies a torque to a trip finger 1935. The trip compression spring 1930 couples to a spring plate 1940 which is released from the trip finger 1935 after the trip finger 1935 rotates from the torque applied by the trip plunger 1925. Extension springs 1945 couple the trip finger 1935 to a stay 1950 attached to the mounting plate 1310. The extension springs 1945 supply a return torque to the trip finger 1935. After it is released, the spring plate 1940 couples stroke adjustment screw 1165 and in turn to the center shaft 1265 to cause closed contacts to rapidly open. A guide post 1955, attached to the head casting 1170, provides a vertical path in which the spring plate 1940 can move.

Figure 20A:
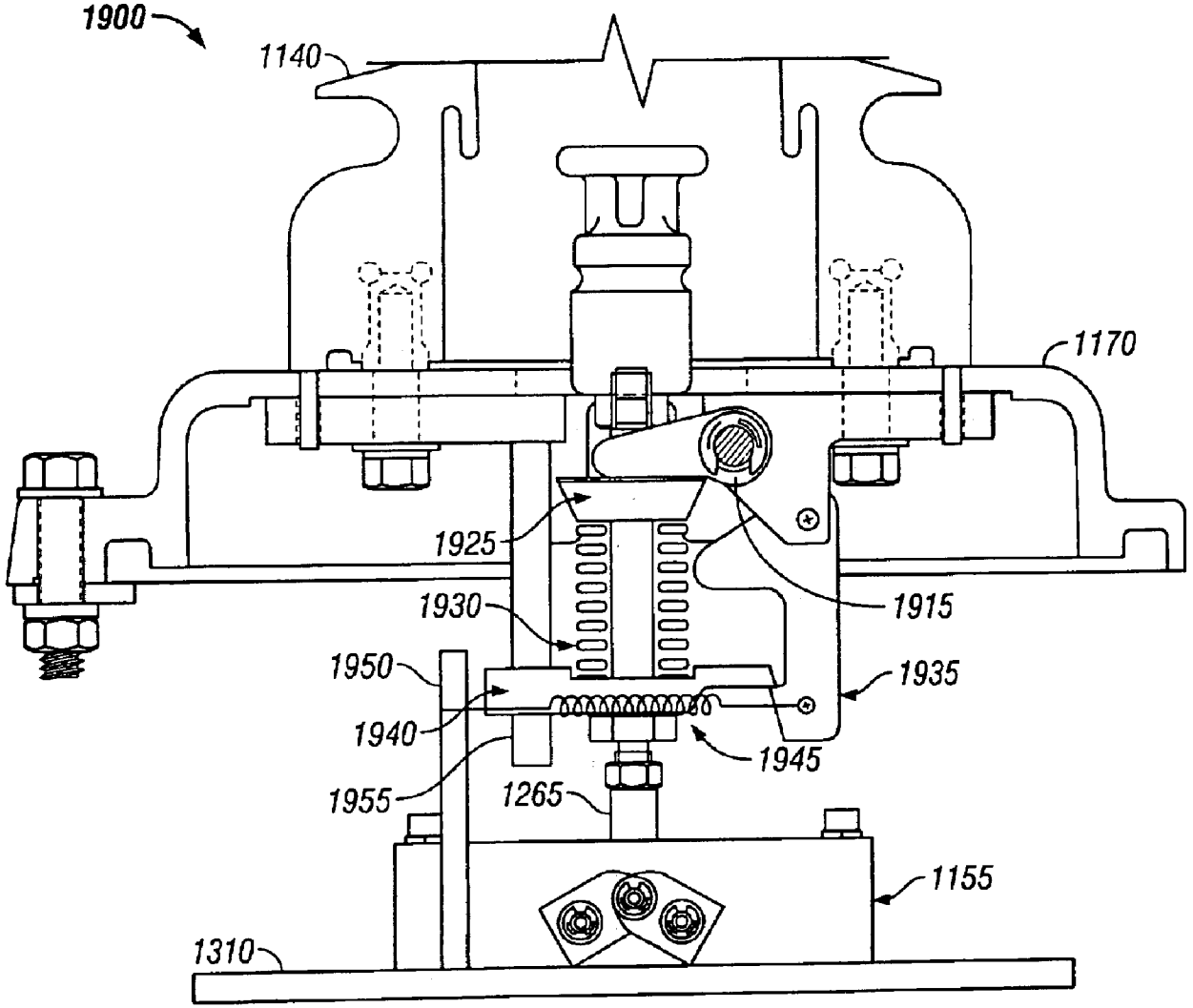
FIGS. 20A–20C illustrate operation of the manual trip mechanism.
Figure 20B:
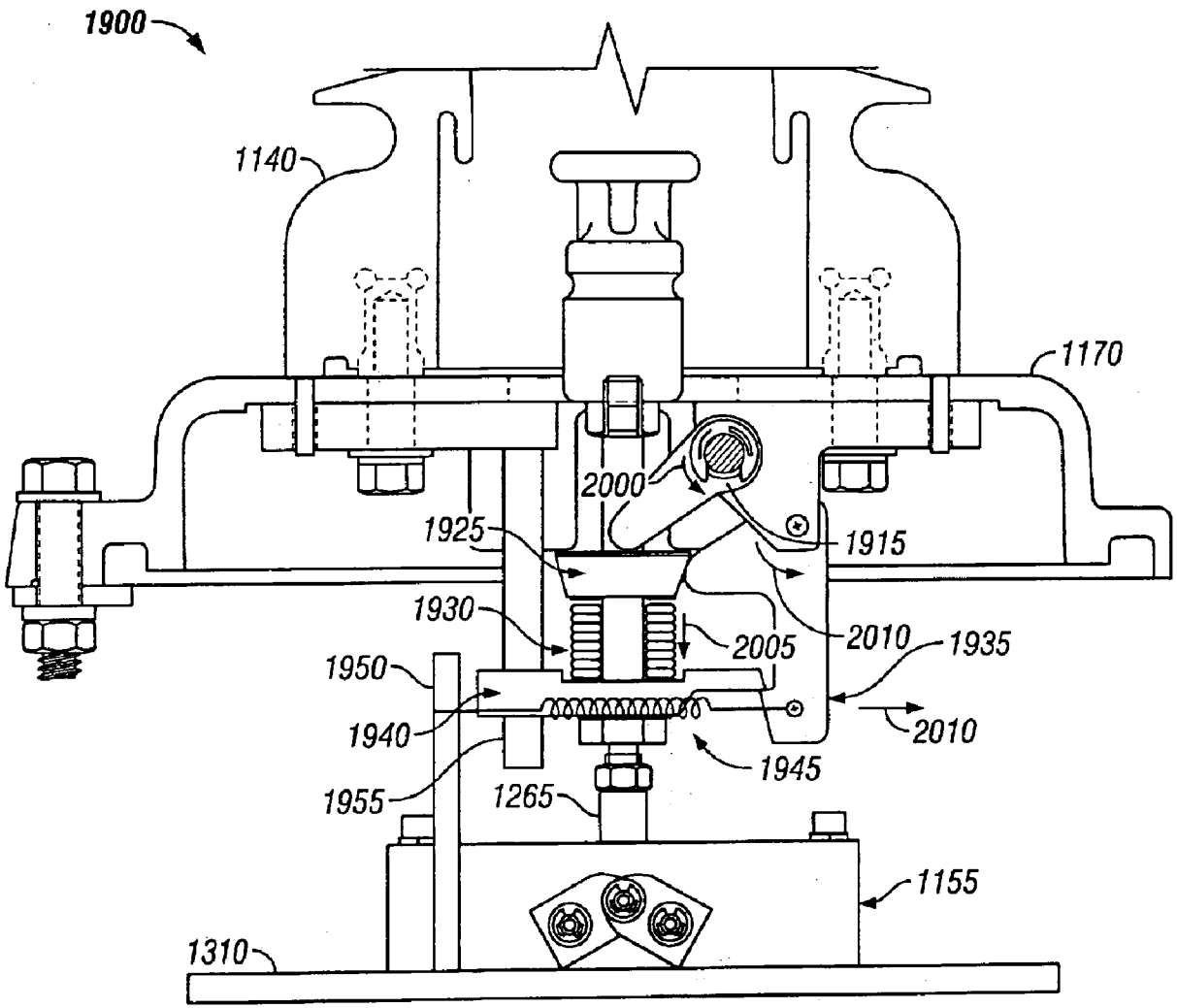
Figure 20C:
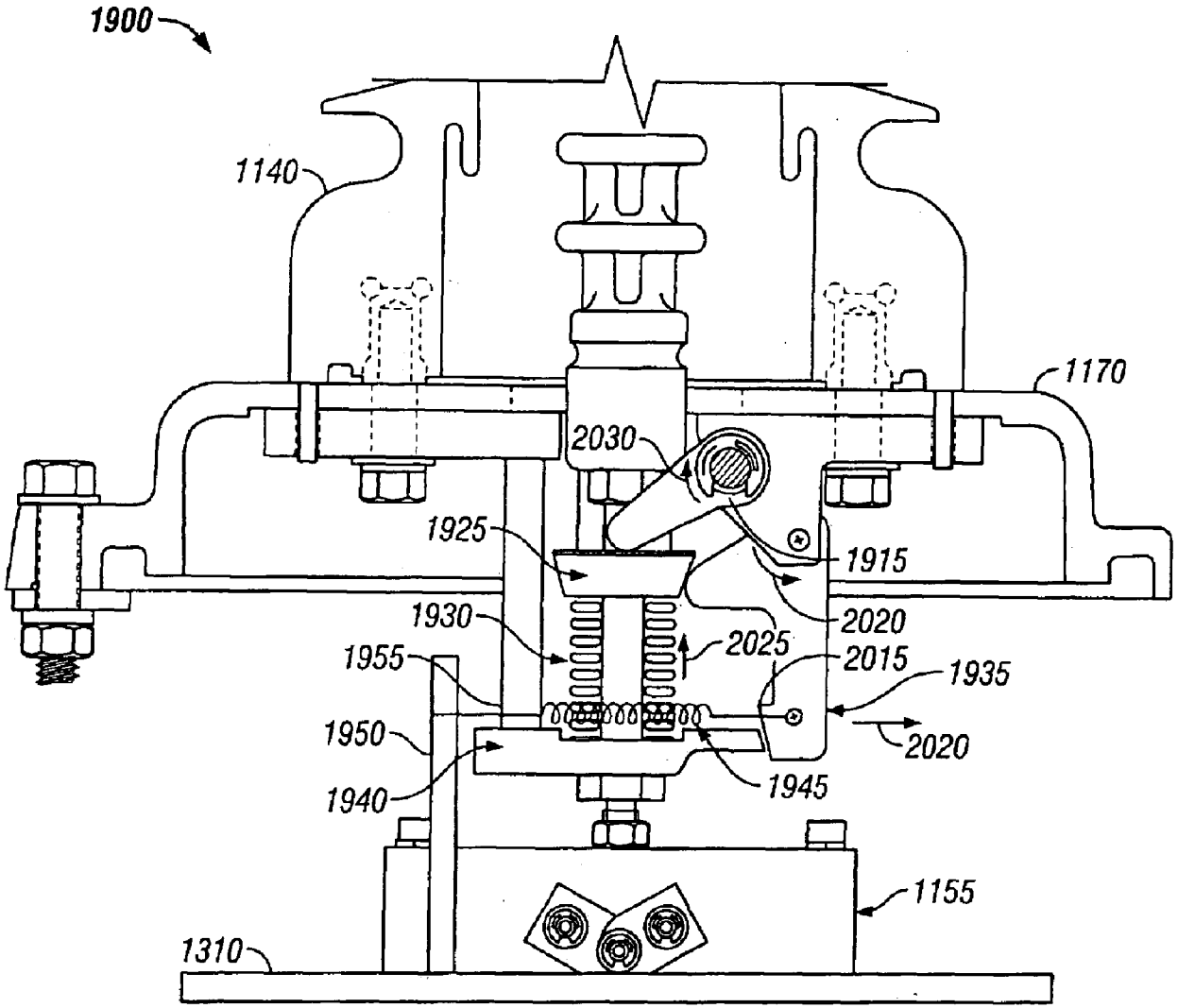

FIGS. 20A–20C describe operation of the mechanical trip mechanism 1900. When switch contacts are in the closed position, the spring plate 1940 is resting on the trip finger 1935. The compression spring 1930 is at its free length and the extension springs 1945 are holding the trip finger 1935 and spring plate 1940 in place.

When the handle 1905 is pulled, the trip lever 1915 rotates counterclockwise (arrow 2000) and pushes down on the trip plunger 1925 which then compresses the compression spring 1930 (arrow 2005) against the spring plate 1940. When the trip plunger 1925 makes contact with the trip finger 1935, a torque applied to the trip finger 1935 causes it to rotate outward (arrows 2010). The force of the compressed spring 1930 is released when the trip finger 1935 is rotated far enough to release the spring plate 1940. Then, the force of the compression spring 1930 drives the spring plate 1940 down, translating the force to the center shaft 1265. This forces the latching device 1155 and the contacts open. The spring plate 1940 passes by the trip finger 1935 once it has been released and the extension springs 1945 pull the trip finger 1935 back against the spring plate 1940.

The mechanical trip mechanism 1900 therefore opens the contacts only after the compression spring 1930 is fully compressed. This provides enough force to the center shaft 1265 to cause the contacts to open as fast as they would during a normal electrical open operation. Furthermore, because the mechanical trip mechanism 1900 does not provide a return force to the center shaft 1265, an operator is prevented from closing the switch contacts using the handle 1905.

The mechanical trip mechanism 1900 may be reset during the next electrical close operation. The motion control circuit 1130 commands the switch to close and the voice coil winding 1115, actuated by the magnetic field generated by current flowing through the voice coil winding 1115, moves the center shaft 1265. The upward movement of the center shaft 1265 pushes the spring plate 1940 upward which forces the trip finger 1935 outward (arrows 2020) and extends the extension springs 1945. When the spring plate 1940 passes a release hook 2015 of the trip finger 1935, the trip finger 1935 snaps inward due to the force of the extension springs 1945 and locks the spring plate 1940 into place. Upward movement of the spring plate 1940 also compresses the compression spring 1930 (arrow 2025), which then pushes the trip plunger 1925 upward. Upward movement of the trip plunger 1925 provides a corresponding torque to the trip lever 1915, which causes the trip lever 1915 to rotate clockwise (arrow 2030) about the trip pivot 1920. Clockwise rotation of the trip lever 1915 resets the handle 1905 to its closed position (shown in FIG. 19). In this position the mechanical trip mechanism 1900 is ready for a next operation.

Figure 21A:
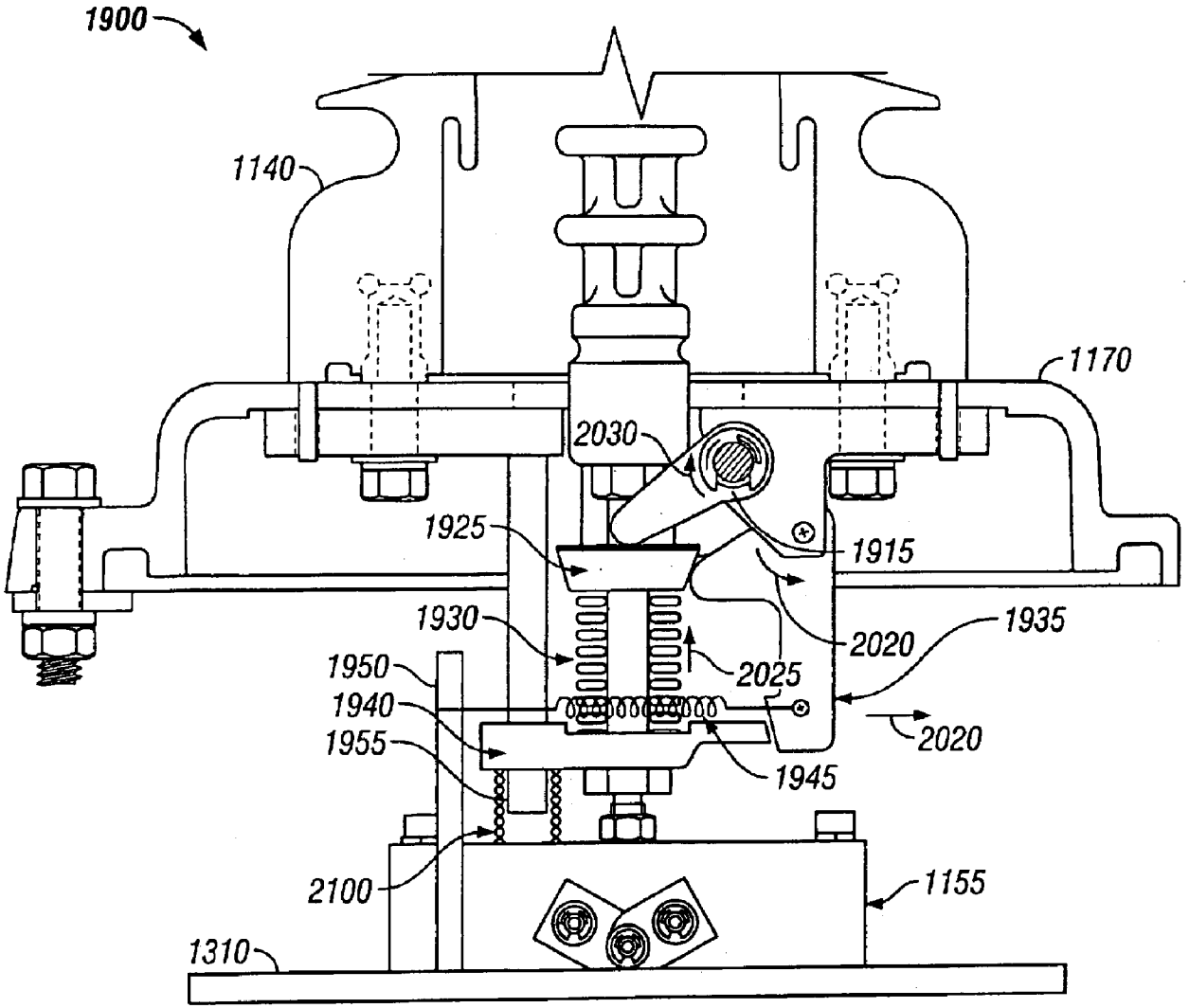
FIGS. 21A and 21B illustrate an automatic reset operation used in the manual trip mechanism.
Figure 21B:
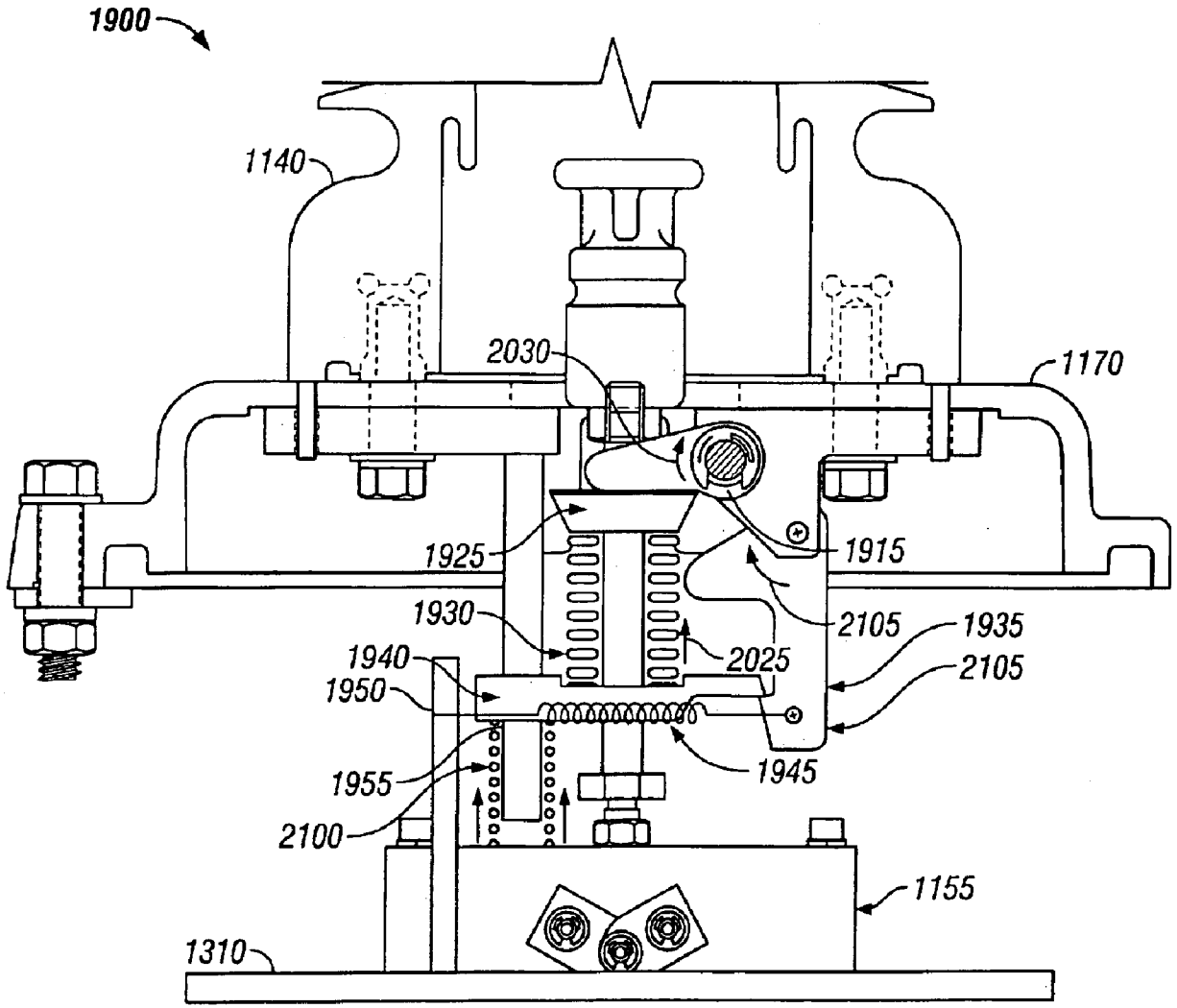

Referring also to FIGS. 21A and 21B, the mechanical trip mechanism 1900 may be designed to automatically reset independently from the electrical close operation described above. In this design, after the spring plate 1940 is released from the trip finger 1935, it compresses a trip return spring 2100. The trip return spring 2100 forces the spring plate 1940 upward, which forces the trip finger 1935 to rotate outward (arrows 2020) and extends the extension springs 1945. When the spring plate 1940 passes the release hook 2015 of the trip finger 1935, the trip finger 1935 snaps inward (arrows 2105) due to the force of the extension springs 1945 and locks the spring plate 1940 into place. Upward movement of the spring plate 1940 further compresses the compression spring 1930 (arrow 2025) which then pushes the trip plunger 1925 upward. Upward movement of the trip plunger 1925 provides a corresponding torque to the trip lever 1915 which causes the trip lever 1915 to rotate clockwise (arrow 2030) about the trip pivot 1920. Clockwise rotation of the trip lever 1915 resets the handle 1905 to its closed position (shown in FIG. 19). In this position, the mechanical trip mechanism 1900 is ready for a next operation. However, unlike the prior resetting of the mechanical trip mechanism 1900, which required an electrical close operation, the latching device 1155 and the contacts remain open until the next electrical close operation.

Automatic reset of the mechanical trip mechanism 1900 may utilize a trip linkage instead of the trip return spring 2100. The trip linkage couples the spring plate 1940 to the trip lever 1915. In this design, there is no trip return spring 2100 to force the spring plate 1940 upward. Instead, the operator manually resets the mechanical trip mechanism 1900 by pushing the handle 1905 clockwise and upward about the trip pivot 1920. This upward motion, via the trip linkage, forces the spring plate 1940 upward, which then forces the trip finger 1935 to rotate outward (arrows 2020) and extends the extension springs 1945. When the spring plate 1940 passes the release hook 2015 of the trip finger 1935, the trip finger 1935 snaps inward (arrows 2105) due to the force of the extension springs 1945 and locks the spring plate 1940 into place. Upward movement of the spring plate 1940 further compresses the compression spring 1930 (arrow 2025), which then pushes the trip plunger 1925 upward. Upward movement of the trip plunger 1925 provides a corresponding torque to the trip lever 1915, which causes the trip lever 1915 to rotate clockwise. (arrow 2030) about the trip pivot 1920 and toward the reset handle 1905. In this position, the mechanical trip mechanism 1900 is ready for a next operation. However, the latching device 1155 and the contacts remain open until the next electrical close operation.

Two or more trip fingers 1935 may be used. However, use of one trip finger 1935 and guide post 1955 provides simplicity and cost reduction.

Other embodiments are within the scope of the following claims.

What is claimed is:

1. A latching device used in an electrical switchgear, the latching device comprising:

a shaft coupled to a contact of the switchgear and operable to move along a shaft axis between a first stable position in which an electrical path including the contact is closed and a second stable position in which an electrical path including the contact is open;

a piston operable to move along a piston axis;

a biasing device coupled to the piston to exert a biasing force on the piston along the piston axis; and a linkage coupling the piston to the shaft;

wherein the linkage is configured such that the biasing force on the piston is transferred to the shaft to bias the shaft to one of the stable positions;

wherein the biasing device exerts a biasing force on the piston that is transferred to the shaft when the shaft is in each of the stable positions.

2. The latching device of claim 1, wherein the shaft is operable to move along the shaft axis between the first stable position, the second stable position, and a third stable position in which an electrical path including the contact is open.

3. The latching device of claim 1, wherein the piston axis is perpendicular to the shaft axis.

4. The latching device of claim 1, further comprising a biasing adjustment that adjusts the biasing force of the biasing device.

5. The latching device of claim 1, further comprising a biasing retainer that fixes the biasing force of the biasing device.

6. The latching device of claim 1, further comprising:

a second piston operable to move along a second piston axis;

a second biasing device coupled to the second piston to exert a second biasing force on the second piston along the second piston axis; and a second linkage coupling the second piston to the shaft;

wherein the second linkage is configured such that the second biasing force is transferred to the shaft to bias the shaft to one of the stable positions.

7. The latching device of claim 6, wherein the shaft is operable to move along the shaft axis between the first stable position, the second stable position, and a third stable position in which an electrical path including the contact is open.

8. The latching device of claim 1, wherein the biasing device comprises a spring.

9. The latching device of claim 1, wherein the shaft is insulated from the contact.

10. The latching device of claim 1, wherein the first stable position is constrained such that the biasing force is maximally coupled to the contact through the shaft.

11. The latching device of claim 10, wherein the constraint ensures that the electrical path is closed in the first stable position.

12. The latching device of claim 10, wherein the constraint accounts for contact erosion.

13. The latching device of claim 1, wherein the second stable position is constrained such that the biasing force is maximally coupled to the shaft along the shaft axis.

14. The latching device of claim 1, wherein the piston is operable to move a distance that ensures that the electrical path is closed in the first stable position and that the electrical path is open in the second stable position.

15. The latching device of claim 1, further comprising a shock absorbing system that comprises:

at least one shock absorbing piston operable to move along a shock absorbing axis and coupled to the shaft; and at least one shock absorbing biasing device coupled to a shock absorbing piston to exert a shock absorbing biasing force on the shock absorbing piston along the shock absorbing axis;

wherein the shock absorbing piston is configured such that the shock absorbing biasing force dampens contact bounce at at least one stable position.

16. The latching device of claim 15, wherein the shock absorbing axis is parallel to the shaft axis.

17. The latching device of claim 15, wherein the shock absorbing biasing force prevents contact bounce at at least one stable position.

18. The latching device of claim 1, wherein the shaft is coupled to multiple contacts of the switchgear.

19. The latching device of claim 18, wherein each contact corresponds to a phase of polyphase AC power.

20. A latching system used in an electrical switchgear, the latching system comprising:

a shaft coupled to a contact of the switchgear and operable to move along a shaft axis between a first position in which an electrical path including the contact is closed and a second position in which an electrical path including the contact is open;

an actuator coupled to the shaft to cause the shaft to move along the shaft axis in response to an open or close command; and a latch coupled to the shaft to maintain the first position as a stable equilibrium position and to maintain the second position as a stable equilibrium position, the latch comprising:

a piston operable to move along a piston axis;

a linkage coupling the piston to the shaft; and a biasing device coupled to the piston to exert a biasing force on the piston along the piston axis, the biasing force being transferred to the shaft when the shaft is in each of the stable positions.

21. The latching system of claim 20, wherein the shaft is operable to move along the shaft axis between the first position, the second position, and a third position in which an electrical path including the contact is open.

22. The latching system of claim 20, wherein the piston axis is perpendicular to the shaft axis.

23. The latching system of claim 20, further comprising a biasing adjustment that adjusts the biasing force of the biasing device.

24. The latching system of claim 20, further comprising a biasing retainer that fixes the biasing force of the biasing device.

25. The latching system of claim 20, wherein the biasing device comprises a spring.

26. The latching system of claim 20, wherein the first position is constrained such that the biasing force is maximally coupled to the contact through the shaft.

27. The latching system of claim 26, wherein the constraint ensures that the electrical path is closed in the first position.

28. The latching system of claim 26, wherein the constraint accounts for contact erosion.

29. The latching system of claim 20, wherein the piston is operable to move a distance that ensures that the electrical path is closed in the first position and that the electrical path is open in the second position.

30. The latching system of claim 20, further comprising a shock absorbing system that comprises:

at least one shock absorbing piston operable to move along a shock absorbing axis and coupled to the shaft; and at least one shock absorbing biasing device coupled to a shock absorbing piston to exert a shock absorbing biasing force on the shock absorbing piston along the shock absorbing axis;

wherein the shock absorbing piston is configured such that the shock absorbing biasing force dampens contact bounce at at least one of the first or second positions.

31. The latching system of claim 30, wherein the shock absorbing axis is parallel to the shaft axis.

* * * * *